US006588168B2

(12) United States Patent
Walters

(10) Patent No.: US 6,588,168 B2
(45) Date of Patent: Jul. 8, 2003

(54) CONSTRUCTION BLOCKS AND STRUCTURES THEREFROM

(76) Inventor: Donald L. Walters, 10420 Fairgrove Ave., Tujunga, CA (US) 91042

( * ) Notice: Subject to any disclaimer, the term of this patent is extended or adjusted under 35 U.S.C. 154(b) by 0 days.

(21) Appl. No.: 09/835,969

(22) Filed: Apr. 17, 2001

(65) Prior Publication Data

US 2002/0148187 A1 Oct. 17, 2002

(51) Int. Cl.[7] ..... E04B 2/00; E04B 2/08; E04B 2/20; E04B 2/56

(52) U.S. Cl. ..... 52/604; 52/605; 52/606; 52/607

(58) Field of Search ..... 52/589.1, 286, 52/592.6, 612, 570, 600, 604–607, 438–439, 432, 561, 565

(56) References Cited

U.S. PATENT DOCUMENTS

| | | | | | |
|---|---|---|---|---|---|
| 468,838 | A | * | 2/1892 | Stieger | |
| 835,669 | A | * | 11/1906 | Eckley | 52/302.4 |
| 2,720,104 | A | * | 10/1955 | Cameron | 52/592.6 |
| 2,861,388 | A | * | 11/1958 | Favaretto | 446/124 |
| 3,618,279 | A | * | 11/1971 | Sease | 52/223.7 |
| 3,782,049 | A | * | 1/1974 | Sachs | 52/309.9 |
| 4,031,678 | A | | 6/1977 | Schuring | 52/285 |
| 4,075,808 | A | * | 2/1978 | Pearlman | 52/439 |
| 4,167,840 | A | * | 9/1979 | Ivany | 52/438 |
| 4,514,949 | A | | 5/1985 | Crespo | 52/585 |
| 4,577,447 | A | | 3/1986 | Doran | 52/571 |
| 4,842,650 | A | * | 6/1989 | Blounts | 106/90 |
| 5,003,746 | A | | 4/1991 | Wilston | 52/589 |
| 5,024,035 | A | | 6/1991 | Hanson et al. | 52/591 |
| 5,421,135 | A | | 6/1995 | Stevens et al. | 52/604 |
| 5,465,542 | A | | 11/1995 | Terry | 52/309.7 |
| 5,685,119 | A | | 11/1997 | Zschoppe | 52/592.5 |
| 5,715,635 | A | | 2/1998 | Sherwood | 52/286 |
| 5,729,943 | A | * | 3/1998 | Cambiuzzi | 52/438 |
| 5,802,797 | A | * | 9/1998 | Storer-Folt | 52/604 |
| 5,839,243 | A | * | 11/1998 | Martin | 52/439 |
| 5,881,511 | A | | 3/1999 | Keller, Jr. | 52/220.2 |
| 5,899,040 | A | * | 5/1999 | Cerrato | 52/604 |
| 5,901,520 | A | * | 5/1999 | Abdul-Baki | 52/592.6 |
| 5,966,889 | A | * | 10/1999 | Zinner | 52/606 |
| 5,987,840 | A | * | 11/1999 | Leppert | 52/592.6 |
| 6,050,873 | A | * | 4/2000 | Reisman | 446/128 |
| 6,065,265 | A | * | 5/2000 | Stenekes | 52/607 |
| 6,088,987 | A | * | 7/2000 | Simmons et al. | 52/592.6 |
| 6,105,330 | A | * | 8/2000 | Nanayakkara | 52/606 |
| 6,108,995 | A | | 8/2000 | Bouchard et al. | 52/609 |
| 6,119,426 | A | | 9/2000 | Escudero | 52/503 |
| 6,122,881 | A | * | 9/2000 | Aubertot | 52/604 |
| 6,223,493 | B1 | * | 5/2001 | Ruggeri | 52/592.6 |
| 6,240,693 | B1 | * | 6/2001 | Komasara et al. | 52/439 |
| 6,244,009 | B1 | * | 6/2001 | Cerrato | 52/604 |
| 6,253,519 | B1 | * | 7/2001 | Daniel | 52/591.1 |
| 6,263,633 | B1 | * | 7/2001 | Hagenah | 52/596 |
| 6,295,778 | B1 | * | 10/2001 | Burt | 52/592.6 |

* cited by examiner

*Primary Examiner*—Jeanette Chapman
(74) *Attorney, Agent, or Firm*—Christopher Whewell

(57) ABSTRACT

Provided herein are blocks useful in the construction of walls and other structures. The blocks include in their design features which render them to be interlocking, and which provide for a wall constructed from the blocks to include a plurality of horizontal and vertical channels that are adapted to receive reinforcing rods ("rebar"). Once a two-dimensional network of rebar is disposed in the interior of such a wall constructed from blocks according to a preferred form of the invention, a castable concrete may be poured into the wall and caused to exist in the spaces between the rebar and the blocks of the invention. By such construction, a wall comprising concrete in its interior that is reinforced in two dimensions is provided, wherein reinforcement in the third dimension is provided by the interlocking feature of the tops and bottom portions of blocks in adjacent rows with one another.

51 Claims, 15 Drawing Sheets

CONSTRUCTION BLOCKS AND STRUCTURES THEREFROM

FIELD OF THE INVENTION

This invention relates to a block unit useful in constructing various structures. More particularly, it relates to a block having specialized contours which renders it particularly useful in providing walls and finished structures having increased strength over prior art constructs, and more particularly those having enhanced resistance to the forces of nature such as high winds and earthquakes. Constructs derived from the block unit and system according to the invention also find use in subterranean earth retention.

BACKGROUND INFORMATION

The concrete block constructions of the prior art are made of individual blocks which are conventionally rectangular in shape, and which generally have one or more cavities through the blocks from their top to bottom, as such are familiar to those in the art. During their use in fabricating structures, a layer of mortar is layered onto a foundation, and a course of closely spaced blocks are laid on the mortar layer, with additional mortar applied between the contiguous block ends. Another layer of mortar is applied to the top of the first course and additional courses are similarly laid, generally staggering the block ends from course to course. Generally, some uncommon degree of skill is required to achieve level courses and a vertical wall, and because of the skill required for such construction, construction costs of such structures are not the most economic availably. These blocks have vertically aligned cavities that can be optionally filled with reinforcing materials such as rebar and concrete to provide added strength to a wall formed from such conventional blocks.

Various types of mortarless interlocking blocks have been devised by various workers to facilitate the construction of block walls and other structures. Most of such blocks have been prohibitively expensive to the end consumer for reasons which include the requirement that the interlocking portions (usually grooves or protrusions) must be cut into the blocks after they have been formed, typically by molding. Further, it is difficult to maintain the required tight tolerances required for accurate construction of large walls or other structures through the molding and cutting steps. The prior blocks often required additional finishing or grinding steps to meet the require tolerances which adds to their production costs.

Certain specialized blocks of the prior art have been used successfully for many years. While generally effective, the prior art block designs often require three or more different block configurations may for many structures, such as walls, buildings with openings and floor panels connected to the block wall. Additional block configurations require the manufacture of additional expensive molds and increased cost and time in changing molds in a block making machine and maintaining and inventory of the different block configurations. Further, many building walls made from the blocks of prior art have excessive thermal conductivity across the wall, which is a particular problem in cold climates where the interior is heated or in hot climates where the interior is cooled. Heat transmission across such a wall varies between areas where the blocks have large open internal cavities and areas where the cavities are filled with concrete reinforcing material or insulative materials. In addition to the undesirable loss of interior heating or cooling through the wall, with heated buildings, cold spots may form on the interior of the wall that condense water from the inside atmosphere and run down the wall.

U.S. Pat. No. 4,031,678 discloses an interlocking building block construction comprising an overlapping masonry block having opposite sides, stepped opposite upper and lower longitudinal faces, and stepped opposite vertical end faces. There are a plurality of spaced tapered recesses with flat bottom surfaces are located on the upper longitudinal face, and a plurality of correspondingly shaped lugs are formed in the lower longitudinal face. There are two enlarged rectangular openings extending entirely through the block located in the central area of the upper and lower faces between the vertical end faces. A plurality of small apertures are formed in and adjacent to the lugs for receiving pins for interlocking adjacent blocks. Header blocks, pilaster blocks, partition blocks and filler blocks are provided for interlocking assembly with the interlocking building blocks to build walls of a building without the use of grout or cement. These special component blocks are formed with tapered recesses and lugs corresponding to the recesses and lugs of the interlocking building block for interlocking assembly therewith.

U.S. Pat. No. 4,514,949 sets forth a wall comprising superposed rows of longitudinally aligned building blocks, the blocks having approximately parallel front and back faces connected by a plurality of transverse webs defining chambers between the webs, the top and bottom of the front and back faces being approximately parallel and providing longitudinally extending tops and bottoms for the blocks, the tops and bottoms being formed to include uniformly spaced apart ball-receiving depressions positioned so that the depressions in the tops of each block mate with the depressions in the bottoms of the block above it, balls fitted into the space defined by mating depressions, the balls being slightly larger than the mating depressions to space the blocks. The depressions in the tops of each block are machined to a specific depth in relation to the height of the block so that the interconnection of the blocks by the balls provides horizontal alignment for each ball-supported block. The upper face of the webs are formed with longitudinally aligned V-shaped grooves which are accurately positioned at a uniform distance from the front faces of the blocks, and elongated straight bars of circular cross-section fitted in the grooves and extending longitudinally and horizontally from one block to the next to provide longitudinal alignment of the blocks in each row.

U.S. Pat. No. 4,577,447 discloses a building block to be used in the construction of houses, buildings, garages, sheds and the like, which is constructed of expanded, polystyrene beads. The building block is to be arranged with other similar building blocks in a vertically orientated, horizontally staggered relationship. Each building block is constructed of two parts which are adhesively secured together in a facing relationship. Each building block includes a pair of vertically aligned openings. When the building block is in the assembled, stacked relationship with other similar building blocks, there are a series of horizontally aligned openings to permit the conducting of rigid reinforcing rods between the blocks. Each building block includes within its upper surface and lower surface interlocking structure which is to interlock with other similar blocks when located in the stacked relationship.

U.S. Pat. No. 5,003,746 teaches a wall assembly comprising a plurality of repeating building blocks successively arranged in a tandem array within a row, the wall assembly comprising a number of rows, each stacked one above another, the tandem arrays within each row facing in an opposite direction with respect to an adjacent row stacked above and below thereto, for the purpose of enhancing lateral forces such as those produced during an earthquake, each building block of the array being generally rectilinear with the exception of two oppositely disposed distal end walls having arcuate, circumferential male and female mating surfaces, respectively, each arcuate, circumferential male and female mating surface having a radial diameter almost equal to a width of the block to further enhance resistance to the lateral forces, each end wall being rotatively engageable with an arcuate mating end wall of an adjacent block of the assembly at any desired angle of rotation within a limited range of arc defined by circumferential end abutments terminating the arcuate mating surfaces of the mating end walls, each male end wall having means defining a hole for receiving vertical reinforcement, each hole being in registry with a hole of a block of an adjacent row stacked above and below thereto, the vertical reinforcement still further enhancing the wall assembly to resist lateral earthquake forces.

U.S. Pat. No. 5,024,035 sets forth a mortarless, lightweight building block and walls formed therefrom. The block is generally rectangular and comprises side walls, end walls, and an interior wall which divides the interior of the block into two vertical passages through the block. In certain blocks, parts of the end and interior walls are removed to form horizontal channels through the blocks. The blocks are provided with projections and recesses having rectangular cross sections by which means they may be interlocked together to form walls. In such a wall, the vertical passages and horizontal channels may receive reinforcing structures to impart added strength and load bearing properties to the wall.

U.S. Pat. No. 5,421,135 discloses a building block, comprising: 1) a pair of longitudinally extending side faces each having a top and a bottom end; 2) a pair of laterally extended end faces joined to the side faces at opposite lateral ends of the block defining an elongate cavity; 3) a pair of protuberances extending from opposite end faces into the cavity, each protuberance having a top face and bottom face and extending completely through the block from the top ends of the side faces to the bottom ends of the side faces; and 4) a pair of tenons attached to and extending out from the top face of the protuberances at opposite lateral ends of the block, each tenon allowing engagement with a corresponding mortise from a vertically adjacent block at different angles within a horizontal plane.

U.S. Pat. No. 5,465,542 teaches Interlocking concrete form modules suitable for creating a concrete wall form is disclosed. The modules have the general shape of a right rectangular parallelepiped with parallel side walls joined by integral webs that define a plurality of parallel elongate cavities. The edges of the side walls include tongues and grooves that allow the modules to be interlocked to form a wall. The ends of the webs are undercut such that cavities between the modules are created when the modules are suitably interlocked. The between-the-module cavities lie orthogonal to the through-the-module cavities. The modules are formed of an insulating material and left in place. Preferably, the tongues along one edge include notches aligned with the webs. In one embodiment, the modules substantially entirely are formed of relatively dense expanded polystyrene ("EPS"). The density of the EPS is adequate to hold threaded wall anchors. In an alternate embodiment, the modules are formed of less dense EPS and include embedded nonmetallic attachment elements that are sized and positioned such that surfaces of the attachment elements lie coplanar with the outer surfaces of the side walls of the modules. Preferably, the nonmetallic attachment elements span substantially the entire height of the modules to create equi-spaced furring strips that cover substantially the entire height of a wall formed when the modules are suitably assembled.

U.S. Pat. No. 5,685,119 sets forth a wall construction, comprising a plurality of shaped bricks joined in dry construction to one another, each brick having a first bearing surface which is provided with a groove formed laterally with a lateral recess, and a second bearing surface which is provided with a key formed laterally with a lateral projection, with the projection and the recess being complementarily shaped and positioned such that the projection on a first brick is engageable with the recess of a second brick when the second brick is stacked on the first brick for restraining displacement in a longitudinal direction of the second brick relative to the first brick, the brick being formed with chases extending perpendicular to the first and second bearing surfaces and including a central channel and semi tubular channels at opposing end faces.

U.S. Pat. No. 5,715,635 teaches a modular building unit adapted for interfitting with adjacent building units; the modular building unit comprising: 1) a block formed of a homogenous material and including a pair of parallel rectangular end supporting faces, a pair of parallel rectangular side faces, and parallel rectangular upper and lower supporting faces; and 2) a pair of continuous mounting strips extending along and supported on the pair of end supporting faces and the upper and lower supporting faces about the entire periphery of the block and projecting outwardly from the block supporting faces, each of the strips having an outer planar surface extending in a generally perpendicular direction from the adjacent supporting faces of the block and recessed inwardly from the adjacent parallel supporting faces of the block a predetermined amount, the mounting strips secured to the supporting faces and having portions thereon for intermitting with mating portions on adjacent modular building units, the mounting strips being mortar and the block being a clay brick.

U.S. Pat. No. 5,802,797 discloses a masonry system in which specially shaped brick are dry-stacked and subsequently bonded by pouring mortar or grout into apertures in the brick to flow through the stacked structure to surround the individual brick leaving the front and rear faces exposed. The brick have alignment projections extending from the bottom bed faces which register with alignment grooves in the top bed faces of the lower brick to align the upper brick prior to bonding. The projections and grooves define a recess to admit mortar between adjacent brick faces. The brick also have recesses in the header faces to admit mortar between adjacent header faces. The front faces of the brick are contoured to create the appearance of mortar joints when the brick are stacked. The brick may be manufactured by extrusion, wire cutting and final shaping using suitable blades to achieve the desired finished shape. If desired, certain apertures through the brick may be covered over using a suitably shaped blade operating under appropriate conditions.

U.S. Pat. No. 5,839,243 teaches an interlocking and insulated form pattern assembly used in creating a wall structure for receiving a poured concrete, the form pattern assembly comprising: 1) a first integrally molded and durable form structure having a substantially rectangular configuration with a height, a length and a width, the first form structure further including a plurality of interiorly and arcuately formed walls which define in combination vertically extending concrete filling passageways and longitudinally extending concrete filling passageways; 2) interlocking means for securing the first form structure in an aligned fashion to additionally and identically construct form structures according to a specified stacking arrangement so that the vertically extending passageways and the longitudinally extending passageways extend continuously throughout the stacking arrangement, the interlocking means including alternating projecting portions and recessed portions extending longitudinally along first and second sides of the rectangularly configured form structure and from both upwardly facing surfaces and corresponding downwardly facing surfaces of the form structure so that a selected form structure is capable of being reversibly engaged with at least one further selected form structure; and 3) moisture drainage means extending both horizontally and vertically within the first form structure and communicating with additional moisture drainage means formed in the identically constructed form structures to create interconnected horizontally and vertically extending drainage channels in the stacking arrangement of form structures, the moisture drainage means including a first plurality of horizontally extending and opposingly mating recessed drainage channels formed along the upwardly and downwardly facing surfaces of each of the selected and stackable form structures, the first plurality of drainage channels communicating with a second plurality of vertically extending drainage channels established within solid wall portions of each of the form structures at spaced apart intervals and in proximity to the first and second sides to create an overall drainage network throughout the wall structure, wherein the stacking arrangement of form structures receiving a poured concrete to fill the vertically and longitudinally extending concrete passageways of the forms, the drainage network being capable of evacuating moisture from within the wall structure of the forms to a footing upon which the form assembly is constructed.

U.S. Pat. No. 6,108,995 teaches a tongue-and-mortise block, for use in the construction of a wall wherein a plurality of like blocks are stacked in successive mortarless overlapping courses so as to define a wall face, the tongue and mortise block comprising two side ends spaced apart by: 1) a top face; 2) a bottom face; 3) a front face; and 4) a rear face, wherein the top face comprises a tongue interlock element and a declining face portion, the declining face portion connecting the tongue interlock element to the front face, the bottom face comprising a mortise interlock element and a forward face portion, the forward face portion connecting the mortise interlock element to the front face. The two side ends, the top face, the bottom face, the front face and the rear face are configured such that, when the block and an underlying, like, block form part of the wall and the bottom face of the block engages the top face of a the underlying block such that the front face of the block defines a portion of the wall face. The tongue interlock element of the underlying block is able to register in the mortise interlock element of the block so as to be able to interlock both blocks such that relative forward and rearward displacement is inhibited. The front face of the block is vertically offset downwardly relative to the tongue element and the rear face thereof.

Attempts have been made to fill the block cavities with loose fiberglass insulation, loose foam particles, foamed in place materials, etc. Loose insulation tends to settle and provide very uneven insulation with resulting cold spots. The insulation cannot be placed in block cavities that are to be filled with reinforcing materials, and this can again result in thermal gradients along the wall, with widely varying interior wall temperatures at insulated and uninsulated areas.

Therefore, there persists a continuing need for improvements in construction block systems to permit lower cost block manufacture and lower cost and more rapid structure assembly from the blocks, as well as the ability to provide thermal insulation in all blocks while still permitting the introduction of reinforcing material into all or some of the blocks. Further, the need for constructs of increased structural strength and integrity persists. The present invention provides a block useful in construction of various structures, which has superior insulative and structural strength properties over blocks of prior art. Further, the blocks of the present invention, by virtue of their design, lend themselves well to mass production of a large number of readily indistinguishable and interchangeable blocks not needing stringent quality control measures during their production as was required by the products of others who tried to provide blocks having the benefits of those provided by the present invention. The features and advantages of the blocks and constructs of this invention will become apparent to one of ordinary skill after reading what now follows.

SUMMARY OF THE INVENTION

The present invention provides a block useful in the construction of walls and the like that is shaped in the general form of a rectangular solid having a length dimension, a width dimension, and a height dimension. A block according to the invention comprises: a flat top portion, a flat bottom portion, a front face portion, a rear face portion, a first end portion, and a second end portion. There is a single channel portion of uniform depth extending along the entire length dimension of the block, which channel has an open portion coincident with the top portion of said block, and which channel has a floor portion whose lowermost point is preferably disposed at depth of between 20.0% to 80.0% of the height dimension of said block, including every hundredth percentage therebetween. The channel has a preferred width of between 20.0% to 80.0% of the width dimension of said block, including every hundredth percentage therebetween. There is further a protruding portion, which extends along the entire length dimension of the block and is defined by the flat bottom portion and a pair of intersecting shoulder notch portions having surfaces which extend along the entire length dimension of the block. One of the shoulder notch portions is disposed on each side of the protruding portion along the entire length of the protruding portion. In an especially preferred form of the invention, the channel includes at least one, and preferably two, hole(s) on its floor portion, which hole(s) have a centerline coincident with the height dimension of the block and which hole(s) passes through to the exterior of the block through the flat bottom portion.

To provide a wall construction using the blocks of the invention, a single first row of blocks as described is first laid in an end to end arrangement, thus defining a first horizontal channel extending along the length of said row. A first horizontal rebar is then provided within the first horizontal channel, which may be supported up from the bottom portion 8 of the channel element 16 by use of a support or spacer. Next, a second row of blocks according to the invention is stacked atop said first row of blocks in a staggered configuration with respect to said first row of blocks, thus defining a second horizontal channel extending along the length of said second row of blocks. A second horizontal rebar is then provided within the second horizontal channel as before, using spacers or supports on the rebar as desired to elevate the rebar from the bottom portion of the channel element. A successive row of blocks according to the invention is next stacked atop the previous row of blocks in a staggered configuration with respect to said previous row of blocks, thus defining a successive horizontal channel extending along the length of said successive row of blocks. Successive horizontal rebar is provided within the successive horizontal channel, and the foregoing is repeated until a desired height of blocks is achieved, at which point the holes that pass through the floor portion of the channel and flat bottom portion of a given block within the wall are aligned with those of blocks above and below said given block, thus defining a plurality of vertical channels within the wall and an upper horizontal channel disposed along the length of the topmost blocks. A vertically-oriented rebar is provided within each vertical channel along the length of the wall, and a castable cement is poured down into the vertical holes and the upper horizontal channel. By the forces of gravity, the cement fills the vertical holes and horizontal channels and with time cures to a hard cement, thus providing a wall having a beneficial combination of superior strength, simplified fabrication, and economic cost over prior art structures.

DETAILED DESCRIPTION

Figure 1:
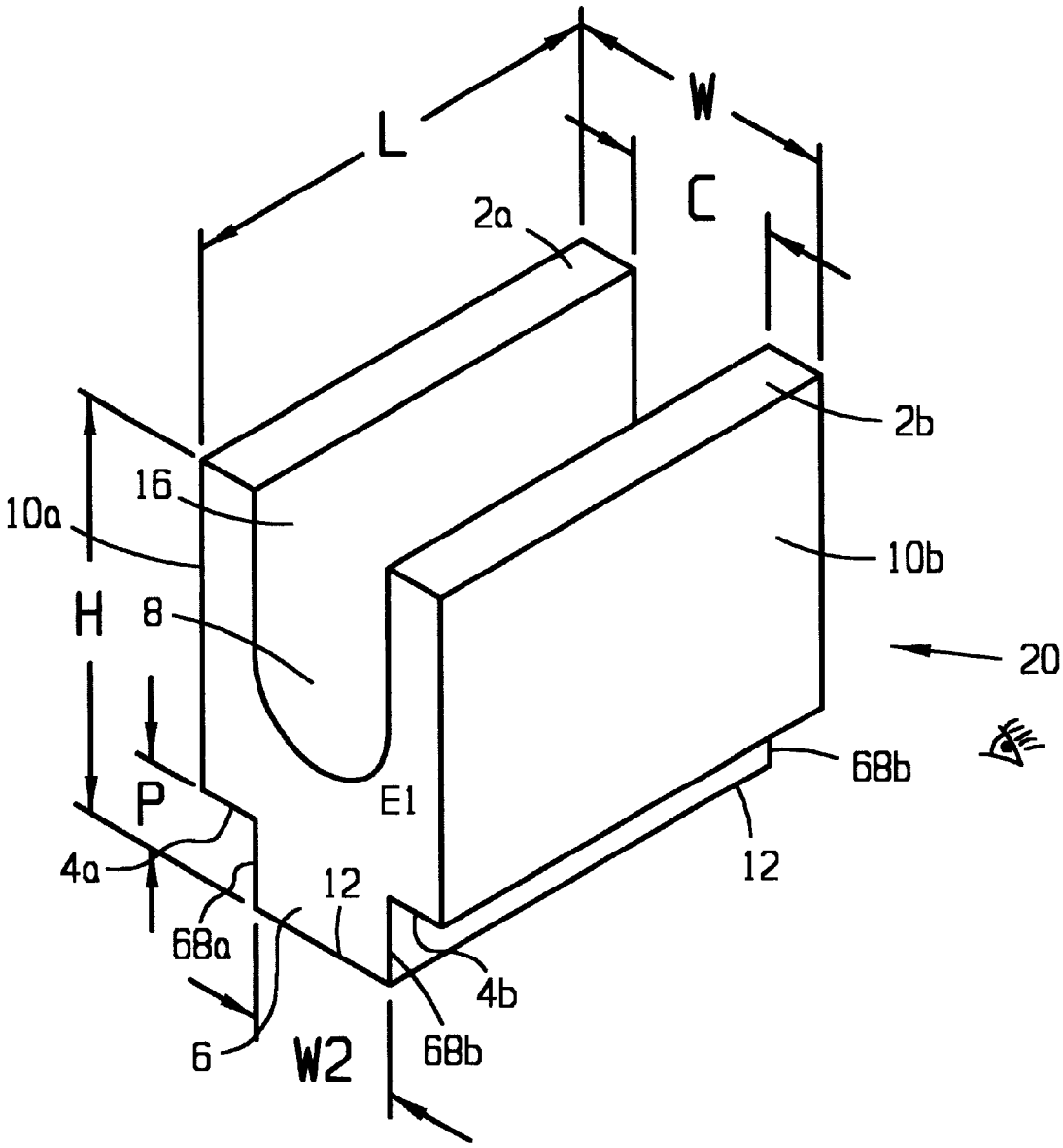
FIG. 1 shows a perspective view of a construction block according to the invention.

Referring to the drawings and initially to FIG. 1 there is shown a construction block 20 according to the invention. Such a construction block exists in the general form of a rectangular solid having a length dimension L, a width dimension W, and a height dimension H. which corresponding to the y, x, and z-axis in conventional three dimensional graphic representations, respectively. There is a channel element 16 which extends along the entire length dimension of the block, wherein the contour at the bottom portion 8 of the channel element is shaped as a semi-circle in a preferred form of the invention, although blocks having other contours, such as those comprising a square-shaped bottom portion, are contemplated herein. By virtue of this hollowed out channel element, having a width C, a block according to the invention appears almost unshaped as viewed from the end as is seen in the other figures, with the exception of the protruding bottom portion 6, having width W2, which protruding bottom portion extends along the entire length of the block at its flat bottom 12. There are flat top surfaces 2*a* and 2*b* on each of the tines of the imaginary "U" which transverse the entire length of the block at its top. The protruding bottom portion 6 may be thought of as "protruding" downward from the flat shoulder surfaces 4*a* and 4*b* a distance equal to P in FIG. 1, and is defined by intersecting shoulder notch portions having surfaces which extend along the entire length dimension of the block. The shoulder notch portions are themselves defined by the flat shoulder surfaces 4*a* and 4*b* and 68*a* and 68*b* that are adjacent to the protruding bottom portion 6. Thus the intersection of 4*a* and 68*a* define a first shoulder notch and the intersection of 4*b* and 68*b* define a second shoulder notch. Thus, there is a shoulder notch portions disposed on each side of said protruding portion. The flat shoulder surfaces 4*a* and 4*b* are preferably flat surfaces which are parallel to the flat top surfaces 2*a* and 2*b* on the top portion of the block, and the surfaces 68*a* and 68*b* are oriented perpendicular to the flat shoulder surfaces 4*a* and 4*b* at their intersection. It is preferred that the surfaces 68*a* and 68*b* are parallel to the front and rear face portions 10*a* and 10*b*. The flat shoulder surfaces 4*a* and 4*b* are conveniently considered to be horizontal shoulder surfaces and the surfaces 68*a* and 68*b* are conveniently considered to be vertical shoulder surfaces for purposes of the invention, as these are disposed horizontally and vertically, respectively, with regard to the z-axis, or height dimension of a block according to the invention.

Figure 8:
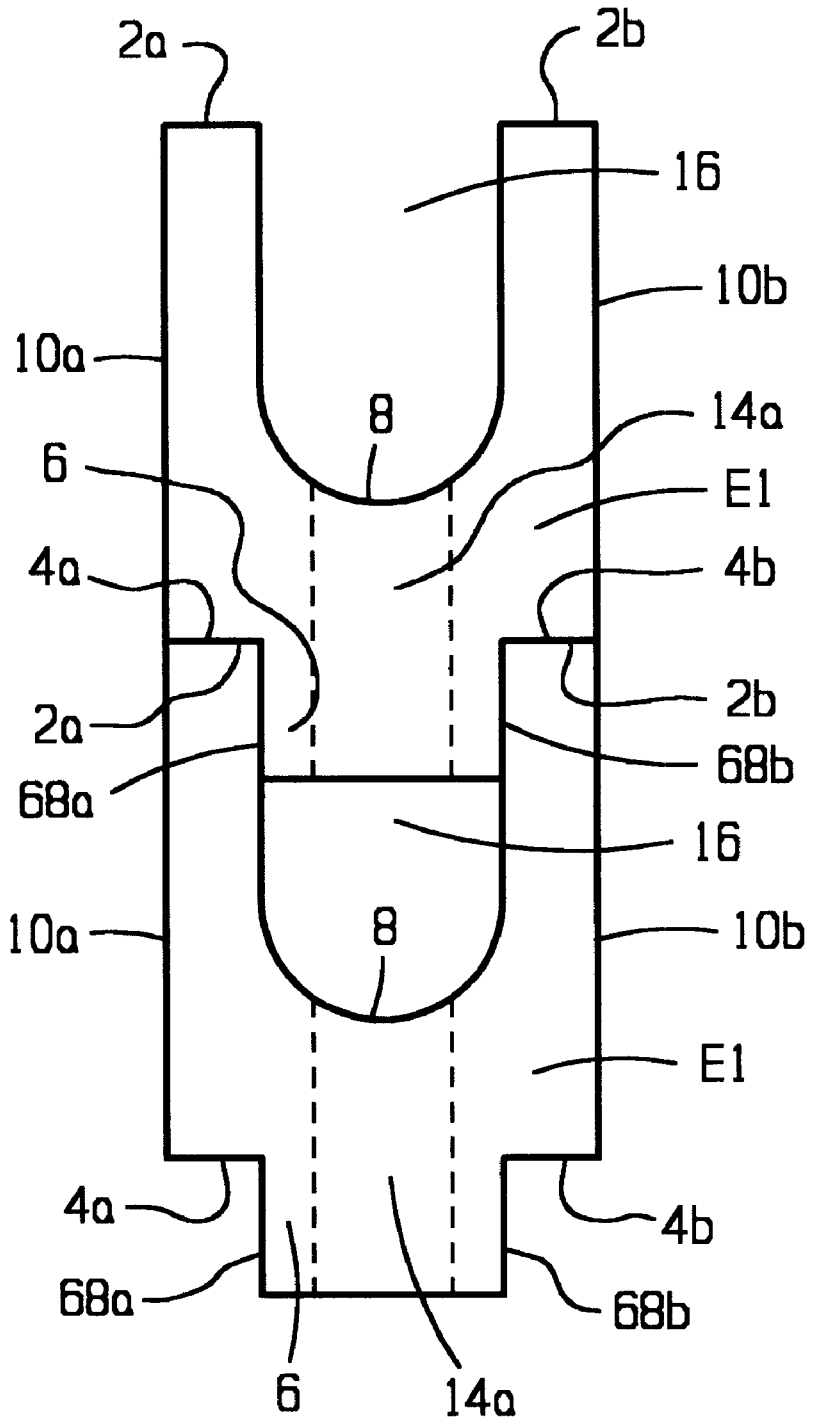
FIG. 8 shows an end view of a pair of construction blocks according to a preferred form of the invention in close contact with one another, including their internal features.

According to such a construction, the channel element 16 of a first block according to the invention is adapted, when its width dimension C is selected to be equal to or just slightly larger than the width W2 of the protruding bottom portion, to receive the protruding bottom portion of another identical block that is stacked atop in an interlocking fashion as is later shown in the figures, particularly later in FIG. 8. In such desired stacked configuration, the flat top surfaces 2*a* and 2*b* on the top portion of a first block disposed beneath another block are respectively in contact with the flat shoulder surfaces 4*a* and 4*b* of the lower portion of a second block that is atop the first block, as shown in FIG. 8. In such a stacked arrangement, the rectangular front and rear face portions 10*a* and 10*b* are all which is visible to an observer (represented by the eye in FIG. 1) in a finished wall comprised of many such blocks arranged in this interlocking configuration.

Figure 2:
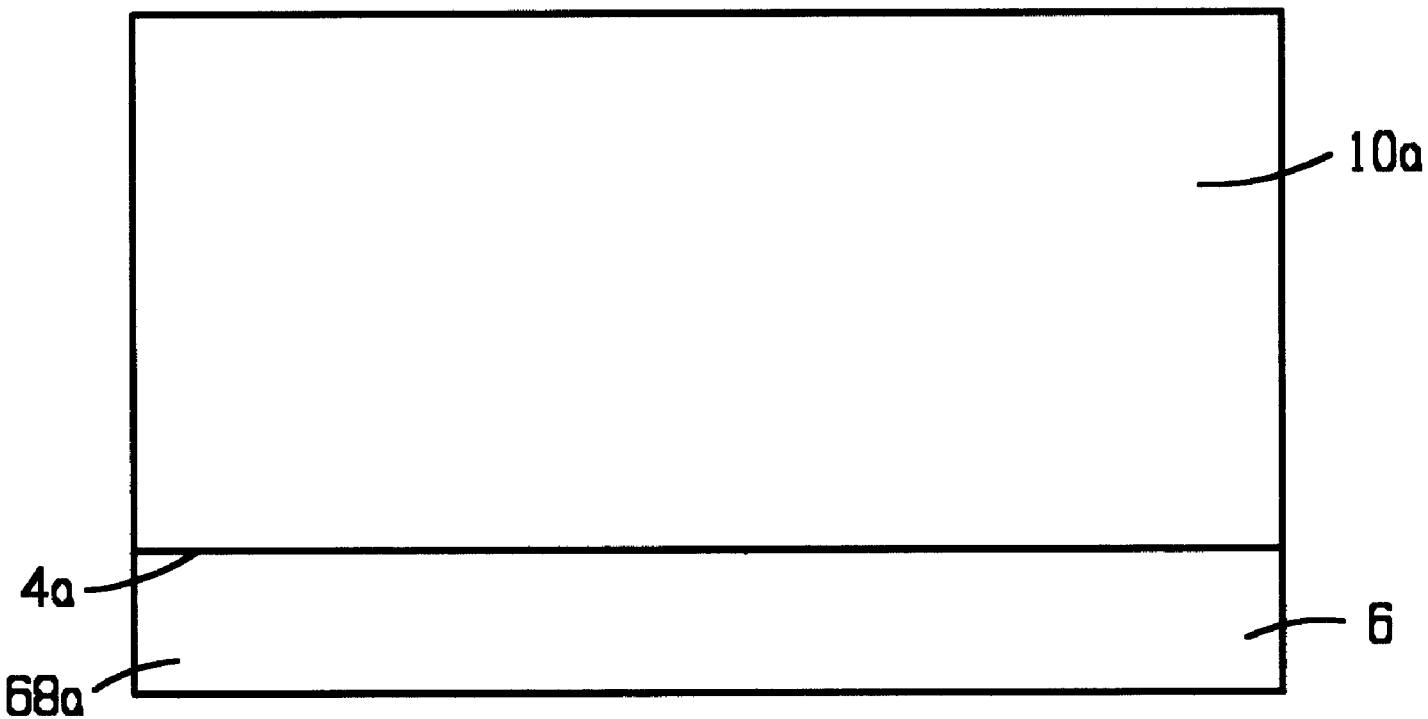
FIG. 2 shows a left side view of a construction block according to the invention.

FIG. 2 shows a left side view of a construction block according to the invention in which the protruding bottom portion 6 is shown, as well as the flat shoulder surfaces 4*a* and 68*a* which are shown to extend along the entire length dimension of the block. Also shown is the rear face of the block 10*a*, which can also be thought of as being the front face, owing to the symmetry of the construction, and a right side view of the same block would appear identical to this left side view.

Figure 3:
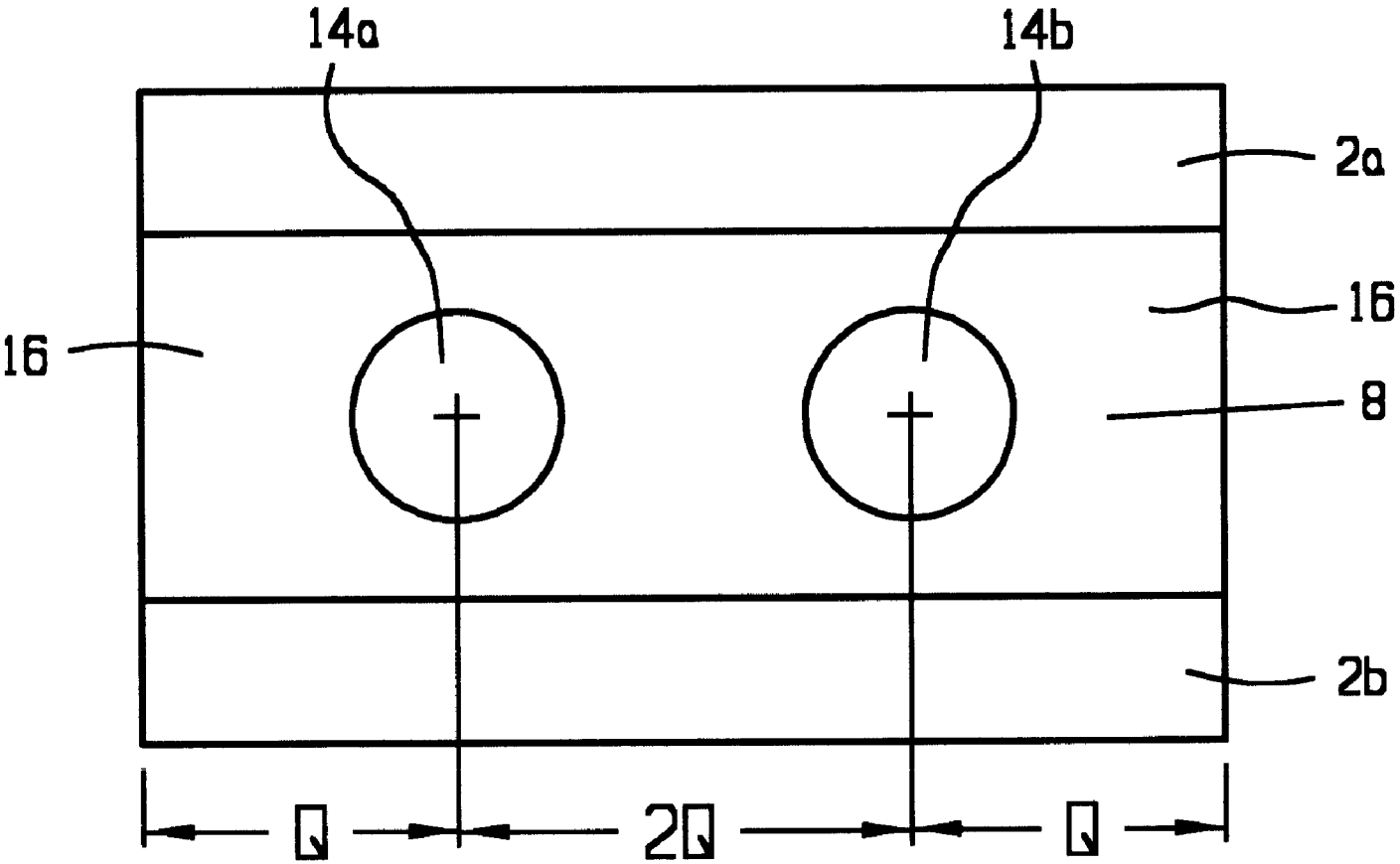
FIG. 3 shows a top view of a construction block according to the invention.

FIG. 3 shows a top view of a construction block according to a preferred form of the invention in which the flat top surfaces 2*a* and 2*b* are shown, as well as the channel element 16 that extends along the entire length of the block, and two holes 14*a* and 14*b* disposed on the floor portion 8 of the channel having centerlines coincident with the height dimension of said block and passing all the way through to the flat bottom portion. The centers of the holes 14*a* and 14*b* are preferably located at equal distances Q from the ends of the block, and the distance between the centers of the holes. Such spacing enables alignment of the hole 14*a* of one block that is stacked atop another block in a staggered configuration with hole 14*b* of the block beneath it, as shown later in FIG. 11. Thus, Q is preferably equal to one fourth of the total block length.

Figure 4:
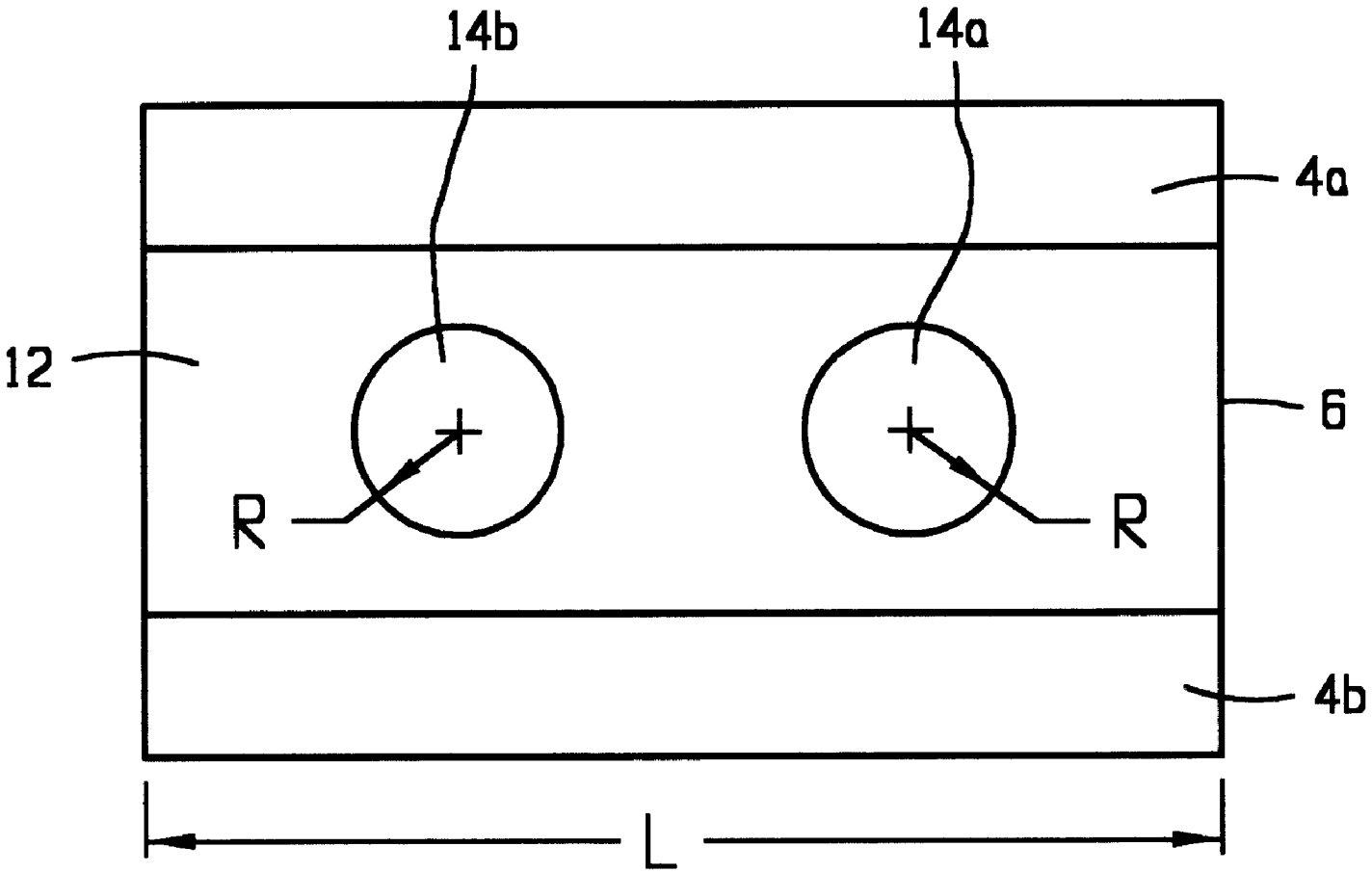
FIG. 4 shows a bottom view of a construction block according to the invention.

FIG. 4 shows a bottom view of a construction block according to the invention in which the flat shoulder surfaces 4*a* and 4*b* are shown, as well as the protruding bottom portion 6 that extends along the entire length of the block, and two holes 14*a* and 14*b* disposed on the flat bottom portion 12 and passing all the way through to the floor portion 8 (not shown in this figure) of the channel element and having centerlines coincident with the height dimension of the block. The radii of the holes 14*a* and 14*b* are preferably equivalent to one another and are equal to any value between 5.00% and 25.00% of the total length dimension of the block, including every hundredth percentage therebetween.

Figure 5:
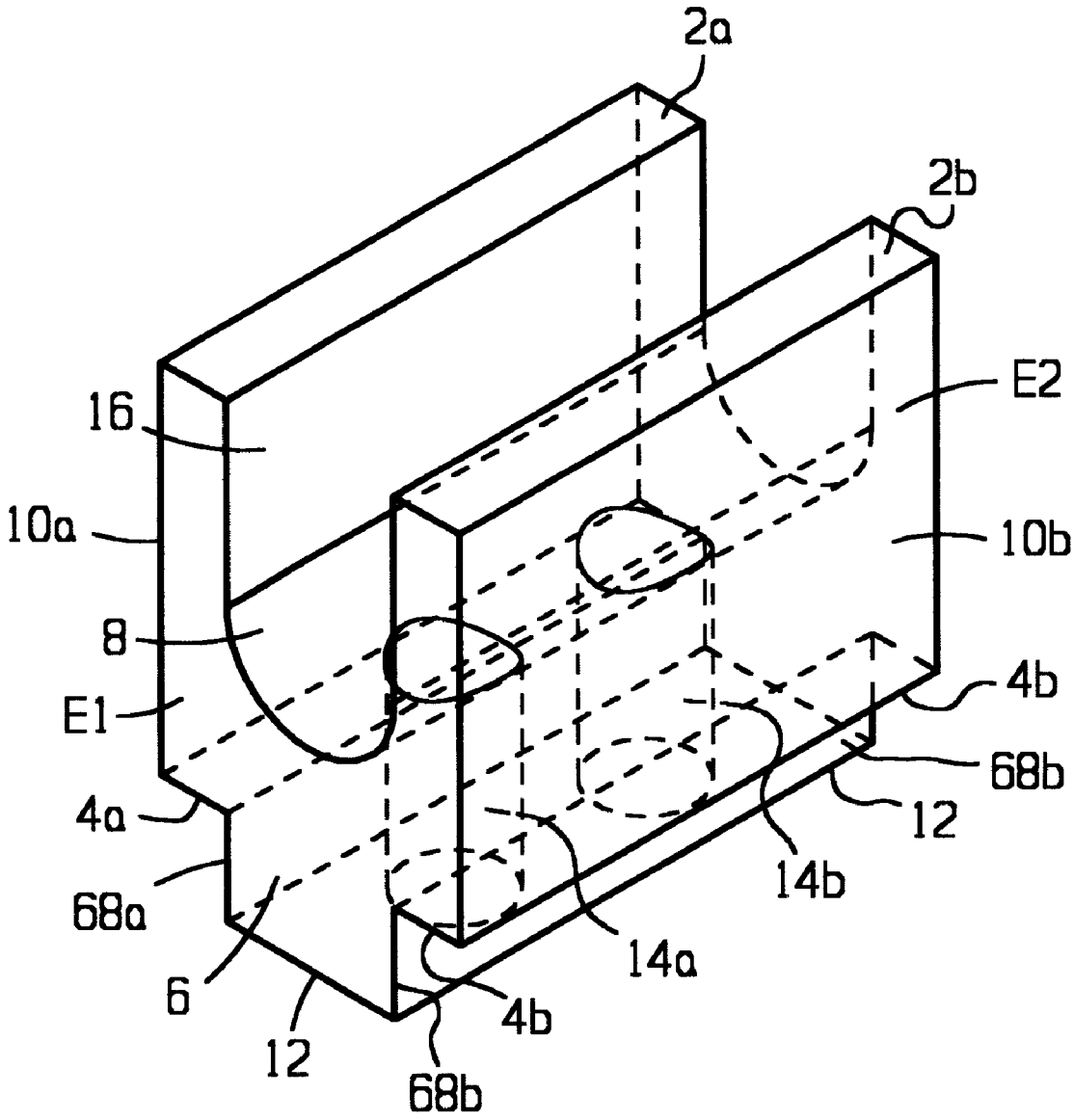
FIG. 5 shows a perspective view of a construction block according to a preferred form of the invention and its internal features.

FIG. 5 shows a perspective view of a construction block according to a preferred form of the invention and its internal features and their locations with respect to one another. Depicted are the flat top surfaces 2*a* and 2*b*, the front and rear face portions 10*a* and 10*b*, and end portions E1 and E2. The channel element 16 and its floor portion 8 are shown, as well as holes 14*a* and 14*b* disposed on the floor portion of the channel element and passing all the way through to the flat bottom portion 12. The flat shoulder surfaces 4*a*, 4*b*, 68*a*, and 68*b* are shown, as well as the protruding bottom portion 6. Although this embodiment shows only two holes disposed on the floor portion of the channel element which pass all the way through to the flat bottom portion, the scope of the present invention includes those embodiments of blocks for which numbers of holes other than two holes are so disposed, including one hole, three holes, four holes, five holes, six holes, seven holes, or eight holes disposed on the floor portion of the channel element which pass all the way through to the flat bottom portion. Preferably, every hole will have a vertical rebar passing through it in a finished construction according to the invention.

Figure 6:
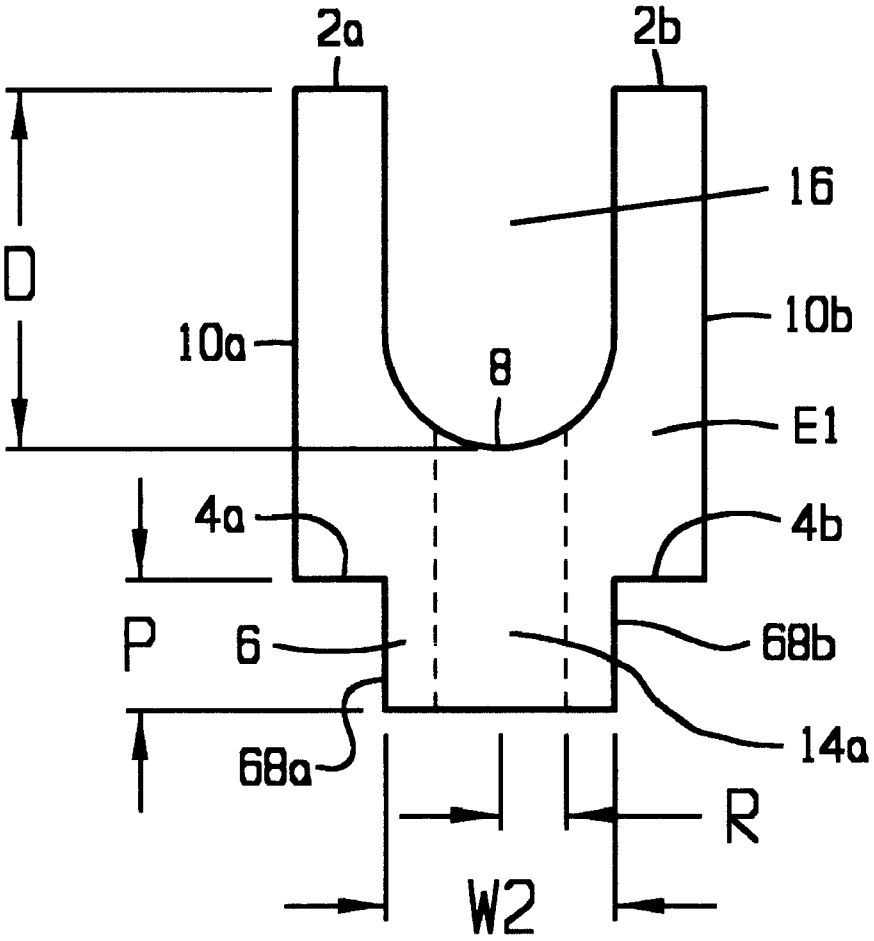
FIG. 6 shows an end view of a construction block according to a preferred form of the invention and its internal features.

FIG. 6 shows an end view of a construction block according to a preferred form of the invention and its internal features, including the flat top surfaces 2*a* and 2*b*; front and rear face portions 10*a* and 10*b*; the channel element 16 including its bottom portion 8 wherein the channel has a depth D; flat shoulder surfaces 4*a*, 4*b*, 68*a*, 68*b*; the protruding bottom portion 6 including its depth of protrusion represented by P and width W2; hole 14*a* having radius r; and end E1.

Figure 7:
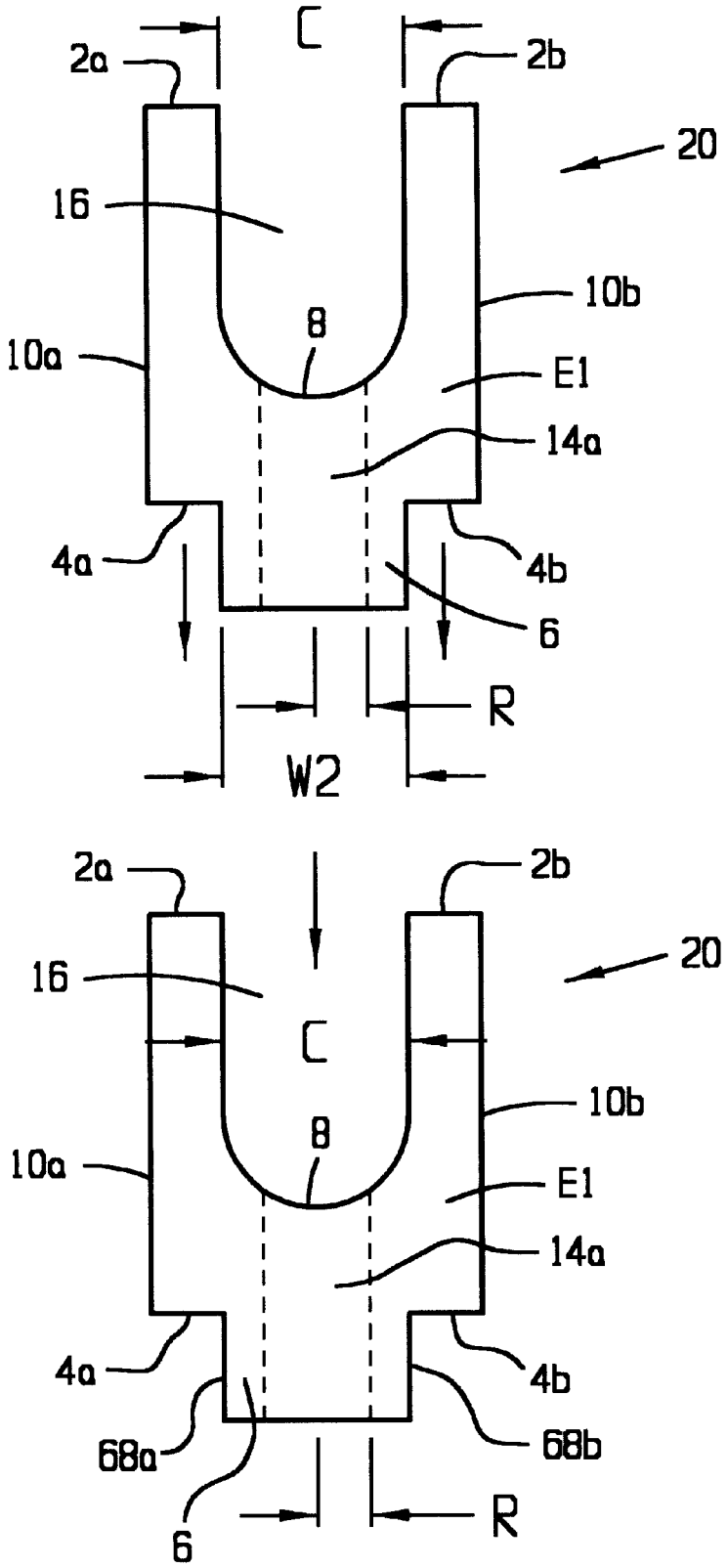
FIG. 7 shows an end view of a pair of construction blocks according to a preferred form of the invention in close proximity with one another, including their internal features.

FIG. 7 shows an end view of a pair of construction blocks 20 according to a preferred form of the invention in close proximity with one another, including their internal features such as the flat top surfaces 2*a* and 2*b*; front and rear face portions 10*a* and 10*b*; the channel element 16 including its bottom portion 8; flat shoulder surfaces 4*a*, 4*b*, 68*a*, 68*b*; the protruding bottom portion 6 having width W2; hole 14*a* having radius r; and end E1. From this figure it can be seen that the protruding bottom portion 6 of the upper block is of sufficient width dimension that it is adapted to be fit into the open portion of the channel element in the block below it, as more clearly shown in FIG. 8. Towards this end, the width W2 of the protruding bottom portion (FIG. 6) is desirably slightly less than the width C (FIG. 1) of the channel element 16 so as to provide a snug fit between blocks above and below one another in a wall construction provided by the invention. Thus, FIG. 8 shows an end view of a pair of construction blocks according to a preferred form of the invention in close contact with one another, including their internal features such as the flat top surfaces 2*a* and 2*b*; front and rear face portions 10*a* and 10*b*; the channel element 16 including its bottom portion 8; flat shoulder surfaces 4*a*, 4*b*, 68*a*, 68*b*; the protruding bottom portion 6; hole 14*a*; and end E1.

Figure 9:
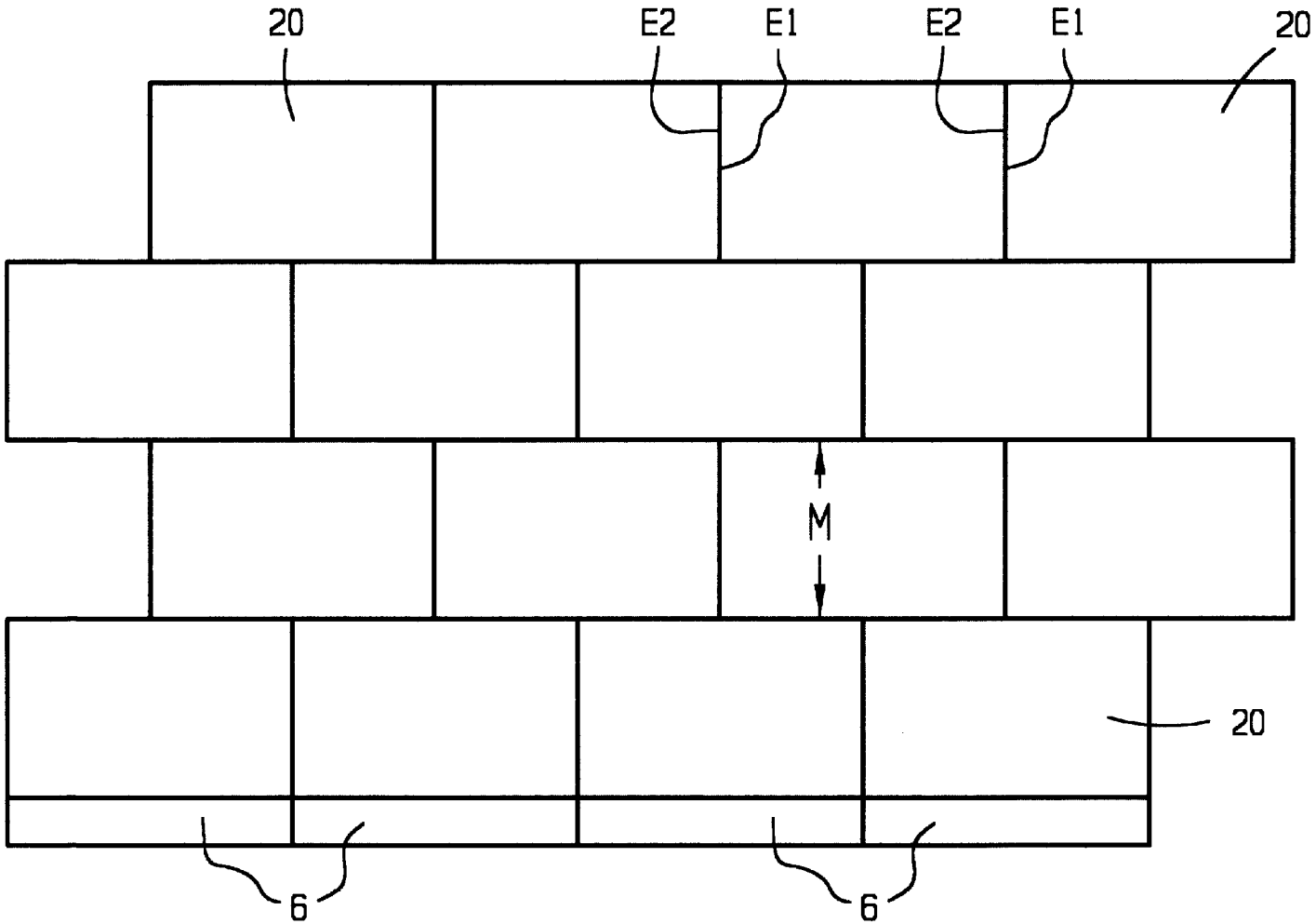
FIG. 9 shows a front view of a wall comprising a plurality of construction blocks according to a preferred form of the invention.

FIG. 9 shows a front view of a wall comprising a plurality of construction blocks according to a preferred form of the invention. There are a plurality of blocks 20 stacked in an interlocking fashion according to FIG. 8 and arranged in a staggered configuration. Staggered means that the blocks are stacked so that the point where the end portions E1 and E2 of adjacent two blocks abut one another within the same row is directly above and below the middle M of blocks in rows above and below the abutting blocks. Such staggered block construction configuration is well known to those skilled in the art. Also shown in this figure is the protruding bottom portion 6 of the blocks of the lowermost row.

Figure 10:
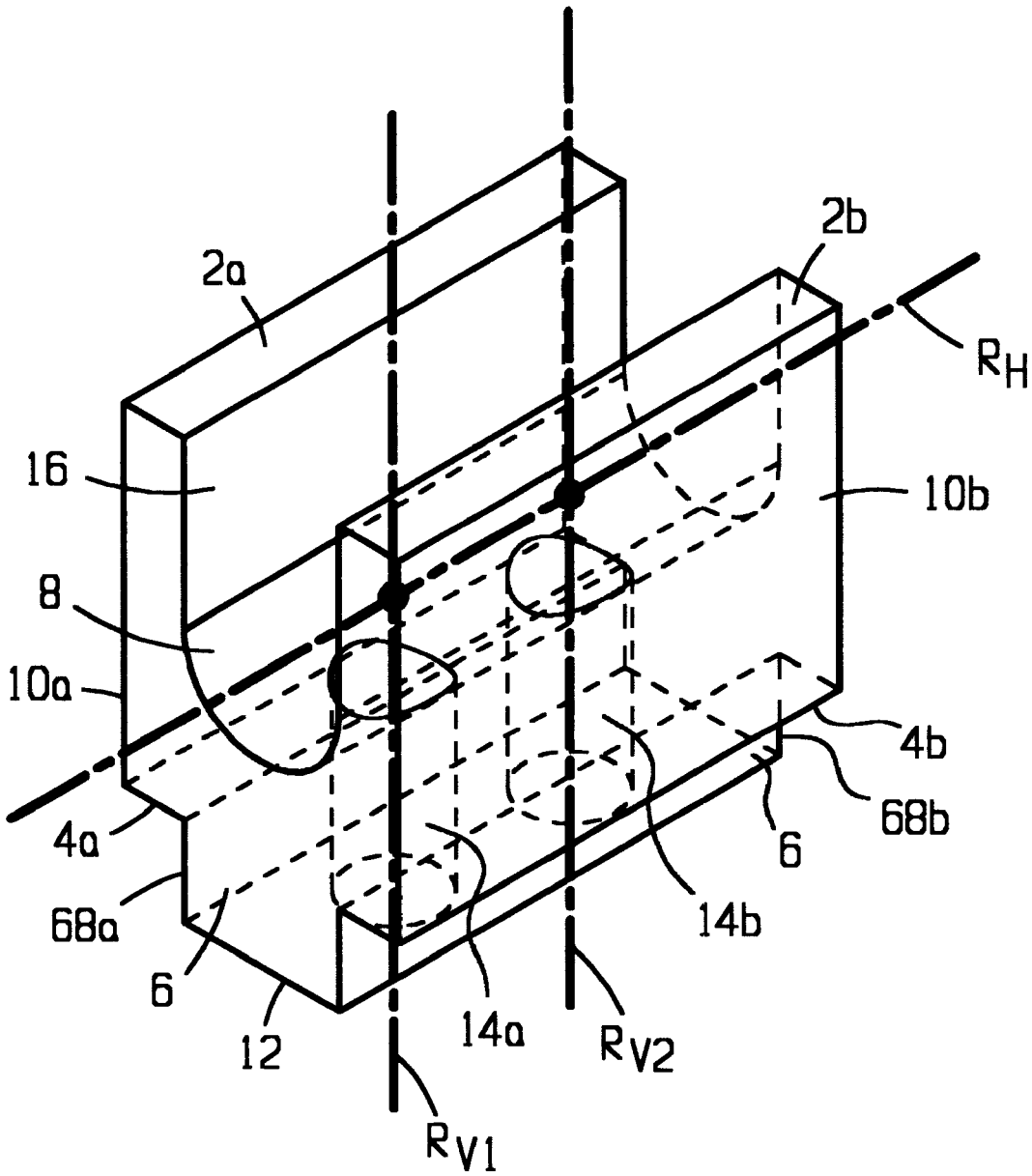
FIG. 10 shows a perspective view of a construction block according to a preferred form of the invention and its internal features and further comprising a plurality of reinforcing rod ("rebar") disposed within the features of the construction block.

FIG. 10 shows a perspective view of a construction block according to a preferred form of the invention and its internal features and further comprising a plurality of reinforcing rod ("rebar") disposed within the features of the construction block. In this figure, shown is channel element 16 which extends along the entire length dimension of the block, and its bottom portion 8. Protruding bottom portion 6 extending along the entire length of the block at its flat bottom 12 is shown, as well as flat top surfaces 2*a* and 2*b*. Shoulder surfaces 4*a* and 4*b* and 68*a* and 68*b* that are shown in their relation to the protruding bottom portion 6. Holes 14*a* and 14*b* are also shown, containing vertical rebar labeled $R_{V1}$ and $R_{V2}$ respectively. There is also shown a horizontal rebar $R_H$ disposed within the channel element and preferably extending along its entire length. Reinforcing rod or "rebar" as it is well-known in the art, is steel rod material that is used in reinforcing concrete structures. Thus, reference to rebar herein includes conventional rebar which is iron or steel rod, but also includes rods comprising other materials, including without limitation other metallic rebars such as aluminum, and polymeric rebars such as polypropylene or fiberglass. Any material which provides reinforcement when placed into concrete is suitable for use as rebar according to this invention provided that such rebar materials may be caused to occupy at least one of either said channel element 16 or a hole 14*a* or 14*b* of a block 20 according to the invention.

In FIG. 10 is shown that the vertically-oriented rebars $R_{V1}$ and $R_{V2}$ intersect with the horizontal rebar $R_H$. It is preferred, although not necessary, that all of the vertically oriented rebars $R_{V1}$ and $R_{V2}$ are connected to all of the horizontal rebars $R_H$ throughout an entire construction made using the blocks according to the invention. This can be accomplished merely by using a tie, such as a short section of wire, around the intersection of the rebars. Alternatively, the rebar at the intersections may be connected to one another by welding. Any means known by those skilled in the art for connecting reinforcing rods ("rebar") to one another is suitable for use in the present invention.

Additionally, since in cases when rebar is to be used internally in the blocks of the invention in a construction of which they are part, a cement will also ultimately be caused to exist around the rebars, both the vertically-oriented rebars $R_{V1}$ and $R_{V2}$ and the horizontally oriented rebars $R_H$. It is most preferably then that the rebar used be centered within the hole or channel in which it is disposed to the greatest extent practical. In the case of horizontally-oriented rebars, the forces of gravity will tend to cause the rebar to rest on the floor portion 8 of the blocks 20. This can be circumvented by the use of any spacer which lifts the rebar off from such bottom portion 8. Literally anything which is capable of supporting the rebar off from the floor portion is suitable as a spacer, including rocks, pieces of wood, wadded paper, etc., with the only requirement being that the rebar is supported from the floor portion. Welding or tying the horizontal and vertical rebars at their point of intersection are preferred means for accomplishing the positioning of the horizontal rebars. It is most preferred in the case of vertically-oriented rebar that the rebar reside along the centerline of the hole in which it is disposed. It is most preferred in the case of horizontally-oriented rebar that the rebar reside at a point intermediate of the width dimension C and at a point which is equal to about ½ C up from the floor portion 8. However, any location of these rebars provide a beneficial degree of reinforcement and the exact location of the rebars may deviate from the preferred positions described above without detracting immensely from the value of the invention. FIG. 10 shows the arrangement of rebar within the block prior to when a castable cement is poured into the construct. By pouring a castable or flowable uncured cementitious material into the channel portion 16 from above, the cement flows to fill the channel, while at the same time flows downward in the holes 14*a* and 14*b* to surround the rebars $R_{V1}$ and $R_{V2}$ and fills the holes. Upon curing of the cement, a rigid, wall construction is provided having rebar reinforcements existing coincident with the length and height dimensions of the blocks, and wherein the blocks are reinforced along their width dimension by the protruding portion 6.

Figure 11:
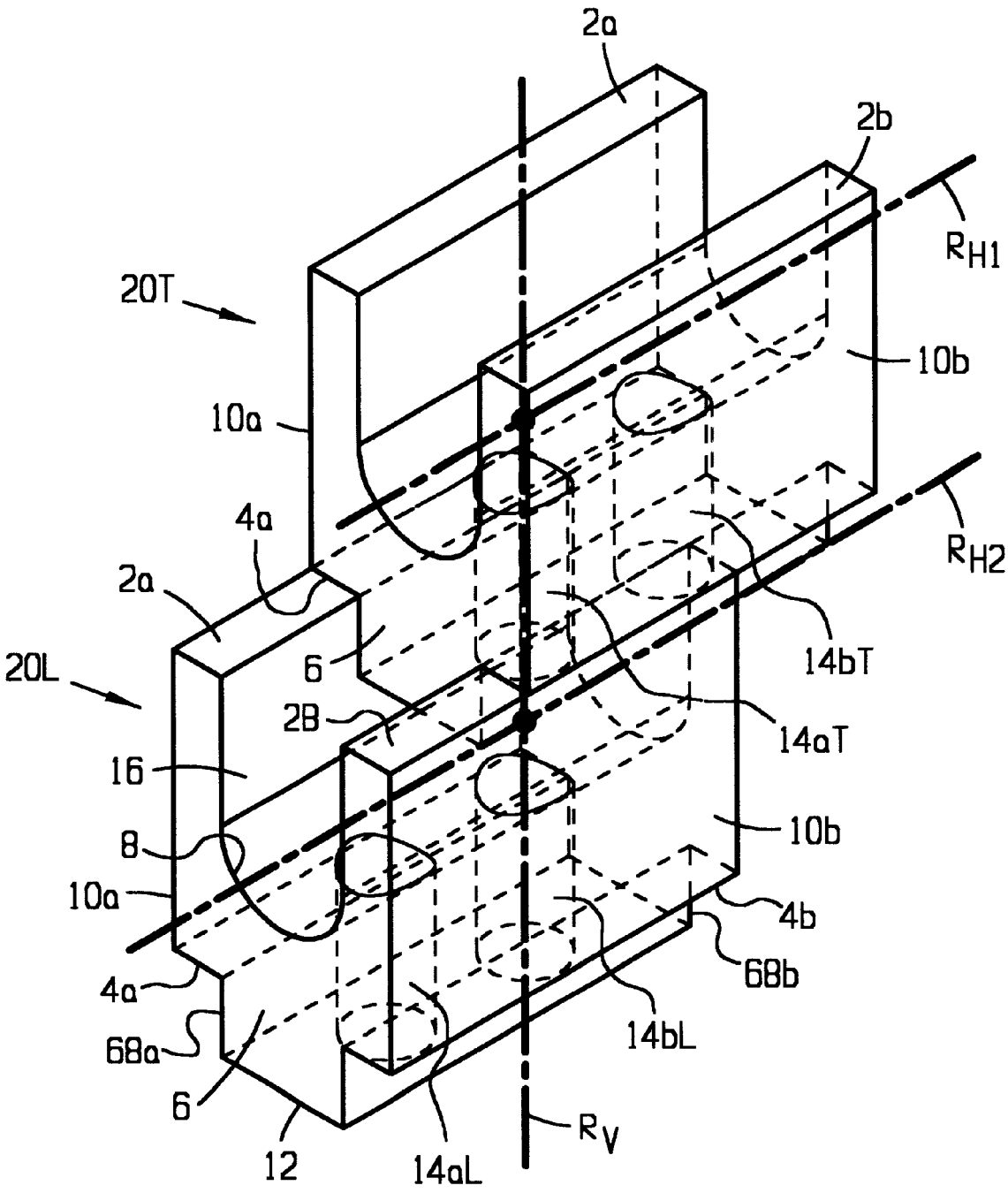
FIG. 11 shows a perspective view of a pair construction blocks according to a preferred form of the invention in a stacked and staggered configuration and their internal features, and further comprising a plurality of reinforcing rod ("rebar") disposed within the features of the construction blocks.

In FIG. 11 is shown a perspective view of a pair construction blocks according to a preferred form of the invention in a stacked and staggered configuration, as well as their internal features, and further showing a plurality of reinforcing rod ("rebar") disposed within the features of the construction blocks provided by the invention. In this figure is shown a top block 20T disposed above a lower block 20L. Each block shown has the same features as hereinbefore described for blocks according to the invention including channel element 16; its bottom portion 8; the protruding bottom portion 6; its flat bottom 12; flat top surfaces 2*a* and 2*b*; front and rear face portion a 10*a* and 10*b*; shoulder surfaces 4*a* and 4*b*, and 68*a* and 68*b*; the protruding bottom portion 6; and holes 14*al* (lower block), 14*at* (top block), 14*bl* (lower block), and 14*bt* (top block). There is a vertically-oriented rebar $R_V$, and a plurality of horizontal rebar $R_{H1}$ and $R_{H2}$ within the channel elements.

In FIG. 11 is shown the preferred staggered configuration of blocks in adjacent successive rows in a wall construction comprising blocks according to a preferred form of the invention having holes disposed in the bottom portion 8 of the channel element and passing through to the exterior of the block through the flat bottom portion 12. A key element of the construction, as mentioned in the earlier discussion concerning FIG. 3, is the spacing of the holes 14*a* and 14*b*, which is most preferably so that a hole in a lower block such as 14*bl* is disposed directly beneath a hole such as 14*at* of a block on top of it, which blocks are stacked in a staggered configuration. By such advantageous spacing, a single channel is formed from the vertical alignment of holes 14*bl* and 14*at* in which a single vertically-oriented rebar such as $R_V$ may be caused to reside. Since blocks according to the invention are typically placed end to end in each successive layer of a wall construction made from such blocks, such an arrangement inherently provides for a series of vertical channels to exist along the interior of a wall comprised of such blocks, along the wall's entire length. Thus, rebar may be caused to reside in each of said vertical channels. Further, since blocks according to the invention are typically placed end to end in each successive layer of a wall construction made from such blocks, such an arrangement inherently provides for a single horizontal channel to exist along the entire length of a wall made from the blocks according to the invention, at every level of block. These combined aspects provide for a wall construction that includes an interlocked stacked arrangement that is internally reinforced by a two-dimensional network of rebars around which a cement may be readily caused to exist, by pouring an un-set cement, to provide a rigid wall. Such wall is additionally reinforced in the third dimension by the interlocking feature provided by the protruding portion 6 of a given block engaging in the channel 16 of a block beneath it and/or by the similar interaction of it with its channel portion and the protruding portion of a block above it.

As an added optional step in the construction of a wall from a plurality of blocks according to the invention, a mortar, cement, or other adhesive or binding substance known to those skilled in the construction art may be applied to any of flat top surfaces 2*a* and 2*b*, or the flat shoulder surfaces 4*a* and 4*b*, the flat shoulder surfaces 68*a* and 68*b*, or the end portions E1 and E2 of blocks during their engagement during construction of a wall, in order to increase the strength of the wall.

Figure 12:
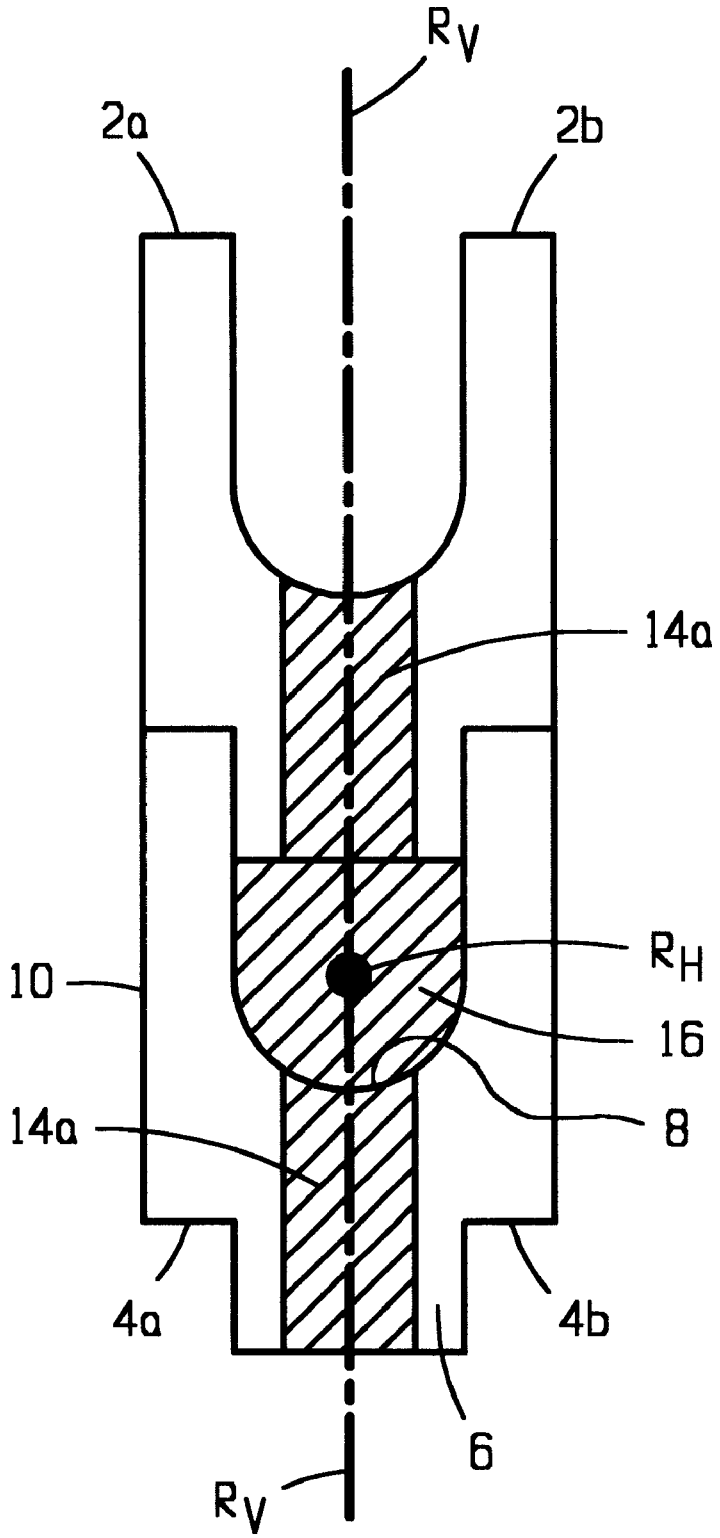
FIG. 12 shows an end view of two construction blocks according to a preferred form of the invention in a stacked and staggered configuration and their internal features, and further comprising a plurality of reinforcing rod ("rebar") disposed within the features of the construction blocks.

FIG. 12 shows an end view of two construction blocks according to a preferred form of the invention in a stacked and staggered configuration and many of their internal and external features as heretofore described, and further comprising a plurality of reinforcing rod ("rebar") disposed within the features of the construction blocks. This figure is much the same as that of FIG. 8, except in this FIG. 12 is further shown the vertical rebar $R_V$ and the horizontal rebar $R_H$ embedded in a cement (shaded), as in a final construct of a wall using the blocks according to the invention. Thus, a cement is seen to fill the vertical channels defined by the alignment of the holes of successively staggered stacked blocks (as per FIG. 11) in their staggered configuration. The cement is also seen to fill the horizontal channel surrounding the horizontally-oriented rebar $R_H$.

Figure 13:
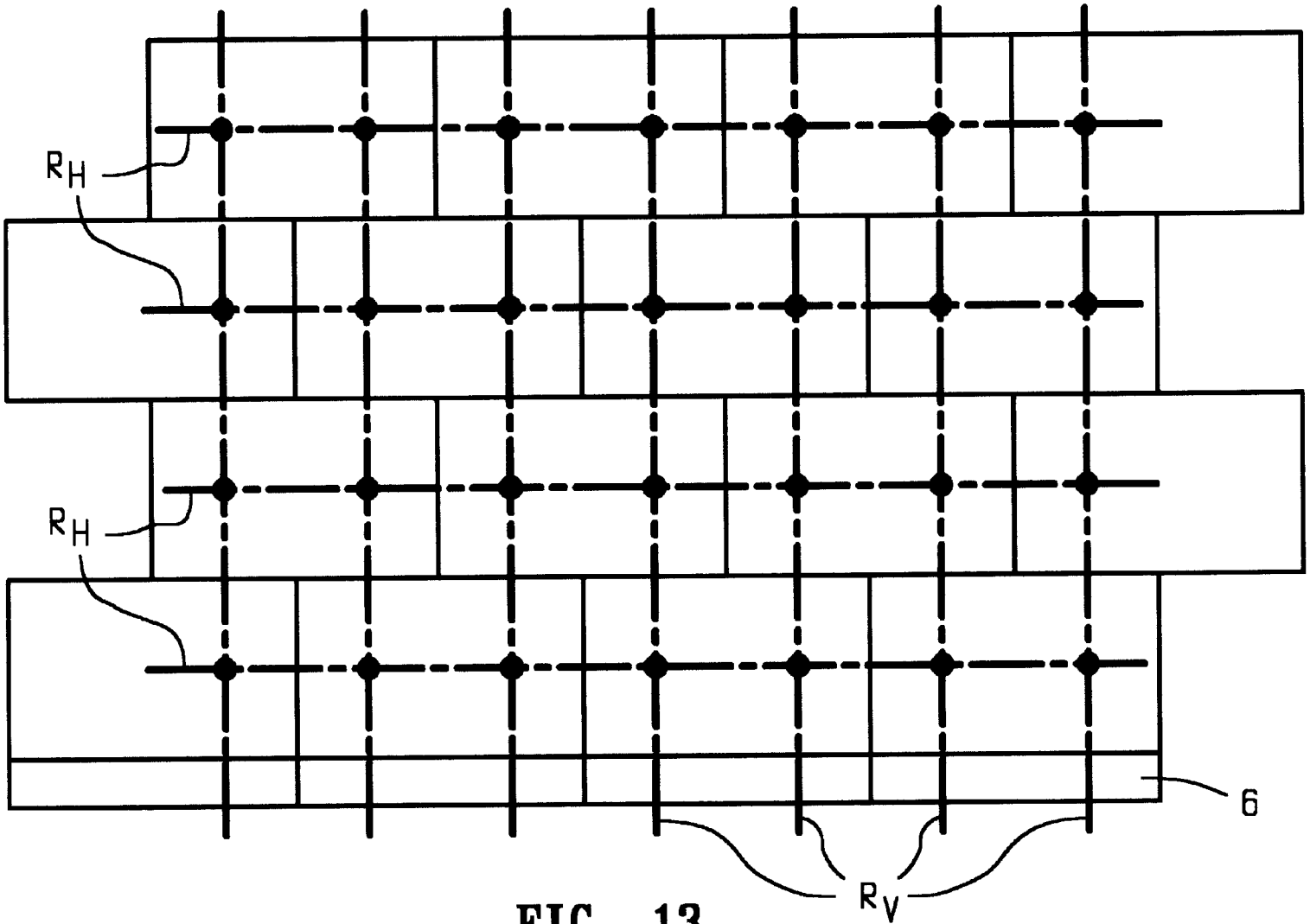
FIG. 13 shows a front view of a wall comprising a plurality of construction blocks according to a preferred form of the invention and further comprising a plurality of reinforcing rod ("rebar") disposed within the features of the construction blocks.
Figure 14:
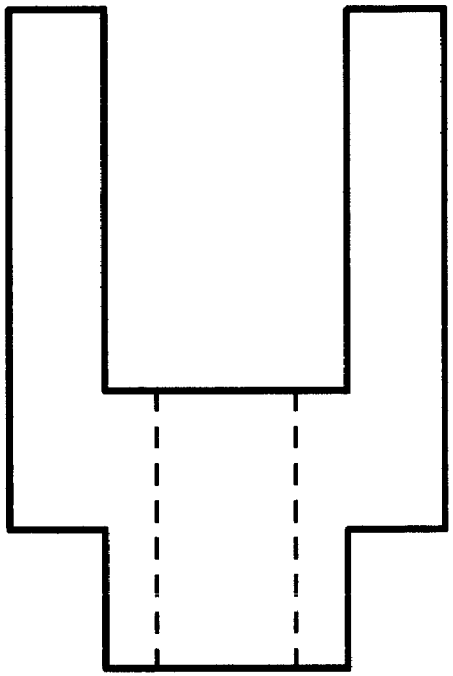
FIG. 14 shows a cross sectional view of a block according to an alternate form of the invention.
Figure 15:
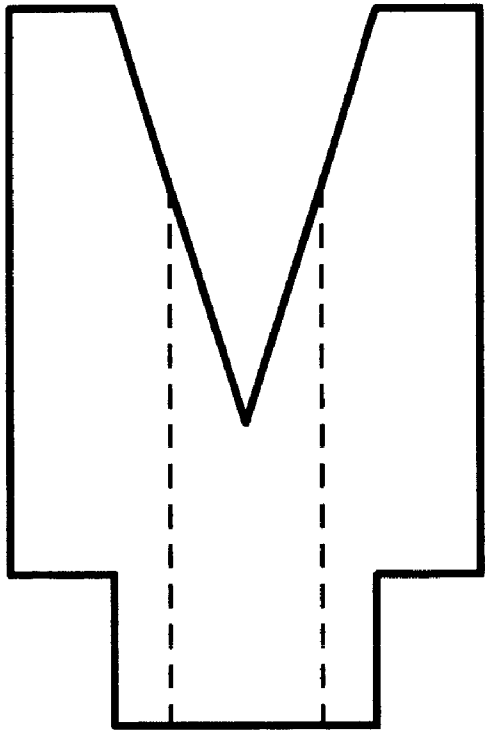
FIG. 15 shows a cross sectional view of a block according to an alternate form of the invention.

In FIG. 13 is shown a front view of a wall comprising a plurality of construction blocks according to a preferred form of the invention including a plurality of reinforcing rod $R_V$ and $R_H$ disposed in the interior the features of the construction blocks, to illustrate the two dimensional network of rebar existing in the interior of the wall construct. Also shown is the protruding portion 6 of the lowermost row of blocks.

To provide a preferred construction such as a wall using the blocks of the invention, a single first row of blocks as described is first laid in an end to end arrangement, thus defining a first horizontal channel extending along the length of said row. A first horizontal rebar is then provided within the first horizontal channel, which may be supported up from the bottom portion 8 of the channel element 16 by use of a support or spacer. Next, a second row of blocks according to the invention is stacked atop said first row of blocks in a staggered configuration with respect to said first row of blocks, thus defining a second horizontal channel extending along the length of said second row of blocks. A second horizontal rebar is then provided within the second horizontal channel as before, using spacers or supports on the rebar as desired to elevate the rebar from the bottom portion of the channel element. A successive row of blocks according to the invention is next stacked atop the previous row of blocks in a staggered configuration with respect to said previous row of blocks, thus defining a successive horizontal channel extending along the length of said successive row of blocks. Successive horizontal rebar is provided within the successive horizontal channel, and the foregoing is repeated until a desired height of blocks is achieved, at which point the holes that pass through the floor portion of the channel and flat bottom portion of a given block within the wall are aligned with those of blocks above and below said given block, thus defining a plurality of vertical channels within the wall and an upper horizontal channel disposed along the length of the topmost blocks. A vertically-oriented rebar is provided within each vertical channel along the length of the wall, and a castable cement is poured down into the vertical holes and the upper horizontal channel. By the forces of gravity, the cement fills the vertical holes and horizontal channels and with time cures to a hard cement, thus providing a wall having a beneficial combination of superior strength, simplified fabrication, and economic cost over prior art structures.

For purposes of this invention and the appended claims, the word "cement" means any material recognized by those in the construction industry as a cementitious material. Included within this definition without limitation are mortars and concretes and any other composition made using a Portland cement, of all types, including common or plastic. Portland cement is a powdered material which is made by burning a ground mixture of limestone and clay or shale to produce clinkers composed primarily of mixed calcium silicates, calcium aluminates, and calcium aluminoferrites. The clinkers, together with a few percent of gypsum, are then ground to a fine powder, which, when mixed with water, forms a paste that, when properly made, sets within a few hours and hardens slowly. When sand or crushed rock and/or gravel, aggregate, etc. are incorporated in cement paste, mortar and concrete are obtained, as the paste acts as the cementing material. Thus, a Portland cement, a mortar, and a concrete all fall within the scope of the word "cement" for purposes of this invention and the appended claims.

According to one preferred form of providing a wall construction using the blocks of the invention, a foundation is first provided, as is known in the art, having rebar rods disposed in a vertical orientation protruding upwards from the foundation. When the rows of blocks according to the invention having holes disposed through their floor portions are put into place, the blocks are slid down over the vertically oriented rebar with the rebar disposed through the holes in the blocks. Then, when the horizontal rebars are placed within the channel portion, they are preferably suspended in place by a conventional means, such as by being tied to the vertically oriented rebars with ties, by welding, or with spacers or any other functionally equivalent means for raising the horizontal rebars above the surface of the floor portion, so that the position of the horizontal rebar is reminiscent of that shown in FIG. 10.

The blocks provided in accordance may be produced from any material(s) which are known in the art from which it is possible to produce a construction block. These materials include, without limitation, castable cements, cement which contains polymers such as concrete mixed with polystyrene, wood, clay, ceramics, fired ceramics, aluminum, steel, other metallic alloys, polymers such as polyethylene, polypropylene, polystyrene, polyurethanes, etc. The blocks according to the invention may also be made from re-cycled materials as well, such as recycled polycarbonates or polystyrene. It is most preferable that a block according to the invention include some polymeric content to increase its R value for insulative purposes. One preferred material composition from which a block according to the invention is made of is a mixture of cement and polystyrene particles. It is preferred from an environmental standpoint that the polystyrene used be recycled polystyrene which has been ground up into a variety of particle sizes, and is often referred to as "reground polystyrene". Reground polystyrene is recycled from waste polystyrene and in this employ becomes the aggregate for admixture with cement in the formation of blocks according to the invention, and replaces the sand and gravel components of a conventional mixture from which construction blocks are made. Since the polystyrene is reground, a variety of particle size are provided and having a variety of particle sizes present has been found to be beneficial to the composition of the blocks.

In the embodiment when the material of choice from which to form blocks according to the invention comprises reground polystyrene and cement, it is beneficial to employ an adhesive during the construction of a wall using the blocks. The adhesive is preferably disposed on at least one and more preferably a plurality of the surfaces of 2*a*, 2*b*, 4*a*, 4*b*, 68*a*, or 68*b* during construction of such a wall. The adhesive may be any adhesive recognized by those in the construction industry as a construction adhesive, and is preferably a polyurethane-based construction adhesive. The adhesive is applied to one or more of these surfaces in order to strengthen the blocks from a "blowout" during the pumping or filling of the blocks with concrete. A blowout is the fracturing of a wall or other portion of a polystyrene-bearing block, or the separation of the blocks due to forces of hydrostatic pressure caused by the presence of the molten/liquid cement. Use of the construction adhesive alleviates this. If the blocks are made with conventional sand, gravel, and cement, the glue is not necessary.

When making blocks according to the invention from polymer particles and a cement, a preferred amount of cement is between 10.00 and 40.00% by volume based upon the total volume of the composition, including every hundredth percentage therebetween. More preferably, the amount of cement is between 20.00 and 30.00% by volume based upon the total volume of the composition, including every hundredth percentage therebetween, with about 25.00% being most preferred. A preferred amount of polymer is between 60.00 and 90.00% by volume based upon the total volume of the composition, including every hundredth percentage therebetween. More preferably, the amount of polymer is between 70.00 and 80.00% by volume based upon the total volume of the composition, including every hundredth percentage therebetween, with about 75.00% being most preferred. When using mixtures of polymer and cement from which to make the blocks of the invention, it is most preferred that the particle size of the polymeric material is in the range of between 0.10 and 1.50 centimeters, including every hundredth centimeter therebetween. More preferably, the polymer particles comprise a plurality of particle sizes between 0.20 and 1.20 centimeters, including every hundredth centimeter therebetween, with an average particle size of about 0.60 centimeters being most preferred.

It is most preferred that the shape of the polymeric material be irregularly shaped, as is the case with reground recycled polymers; however, any shape of particles may be used to provide blocks according to the invention, including spheres, spheroids, rectangular solids, cubic solids, conically shaped solids, extruded shapes, etc.

In one preferred embodiment, fibrous reinforcing materials may be incorporated into the mix from which blocks according to the invention are yielded. The use of such fibrous materials increases the strength of the blocks, and may be of any composition having a tensile strength equal to at least that of low density polyethylene. Suitable fibrous materials include asbestos fibers, polyethylene fibers, polystyrene fibers, polypropylene fibers, keratin fibers, or any other fibrous material capable of increasing the strength of the blocks. It is preferred that the fibers have a length between about 0.10 and 3.0 centimeters, with about 0.75–1.00 centimeter being most preferred. The diameter of the fibers may be any size in the range of between about 0.10 millimeters to 2.0 millimeters, with about 0.30 millimeters being most preferred.

One added advantage of incorporating polymeric material into the composition from which a block according to the invention is made is that such incorporation decreases the total weight of the blocks. Thus, all of the advantages previously described as being made possible by the blocks of this invention are achievable in a more lightweight construction than has been heretofore available, and the insulative character of walls made from such blocks is substantially enhanced over the contents of the prior art.

While one method for providing the blocks according to the invention is by using a subtractive process such as sculpting or machining, the most preferred process for producing blocks according to the invention is to use a molding process in which a molten material from which it is desired to have the blocks be composed is caused to reside in a mold having the configuration of the desired finished block, as in the well-known cases where the blocks are desired to be composed of a resin such as polyethylene or polypropylene, and injection molding techniques are employed. In the case of when it is desired to make blocks according to the invention from a mixture of a cement and a polystyrene or other polymer, the process for making such blocks begins with first preparing an uncured paste from which the blocks are to be formed by mixing the cement and the polymer in a mixing device such as a screw/auger, rotary, or standard cement mixer of those various sizes commercially available in the marketplace. Next, molds are provided of the desired shape of the block to be produced, and the uncured paste is poured, injected, or otherwise caused to reside in the mold cavity using conventional means, and the paste is allowed sufficient time to set, after which the block is separated from the mold. Such a block product, made from polymer particles and cement has beneficial insulating properties, and may be conveniently referred to as an insulated concrete form (ICF), which means that it is insulation which stays in its place after the cement is poured. Further, the blocks according to the invention may be of any size needed to accommodate engineering needs for a given project. Blocks according to the invention are thus not limited in their size dimensions except as otherwise expressly stated herein. In some cases blocks according to the invention may be 8 inches wide with 4 inch diameter holes and in other cases the blocks may be 12 inches wide with 8 inch holes, to cite but two of the myriad of possible dimensions selectable.

Consideration must be given to the fact that although this invention has been shown, described, and disclosed in relation to certain preferred embodiments, obvious equivalent modifications and alterations thereof will become apparent to one of ordinary skill in this art upon reading and understanding this specification and the claims appended hereto. Accordingly, the presently disclosed invention is intended to cover all such modifications and alterations, and is limited only by the scope of the claims which follow.

I claim:

1. A block useful in the construction of walls that is shaped in the general form of a rectangular solid having a length dimension, a width dimension, and a height dimension, comprising:

a) a flat top portion;

b) a flat bottom portion;

c) a front face portion;

d) a rear face portion;

e) a first end portion; and f) a second end portion, g) a single channel portion of uniform depth extending along the entire length dimension of the block, which channel has an upper portion coincident with said top portion of said block, and which channel has a floor portion whose lowermost point is disposed at depth of between 20.0% to 80.0% of the height dimension of said block, including every hundredth percentage therebetween, and wherein said channel has a width of between 20.0% to 80.0% of the width dimension of said block, including every hundredth percentage therebetween; and h) a protruding portion, which protruding portion extends along the entire length dimension of the block and is defined by said flat bottom portion and a pair of intersecting shoulder notch portions each having a single horizontal shoulder surface and a single vertical shoulder surface which extends along the entire length dimension of said block, with one of said shoulder notch portions being disposed on each side of said protruding portion along the entire length of the protruding portion, and wherein each of said shoulder notch portions is formed from the intersection of said horizontal shoulder surface and said vertical shoulder surface, wherein said horizontal shoulder surface and said vertical shoulder surface form a single angle at their point of intersection.

2. A block as in claim 1 wherein said protruding portion comprises a width dimension which is less than the width of said channel portion.

3. A block as in claim 1 wherein said shoulder notch portions are each formed by the intersection of a horizontal shoulder surface and a vertical shoulder surface.

4. A block as in claim 3 wherein said single angle at which said horizontal shoulder surface and said vertical shoulder surface intersect is any angle between about 60 degrees and 120 degrees.

5. A block as in claim 3 wherein the angle at which said horizontal shoulder surface and said vertical shoulder surface intersect is about 90 degrees.

6. A block as in claim 3 wherein the horizontal shoulder surfaces of each of the shoulder notch portions are parallel to one another.

7. A block as in claim 3 wherein the horizontal shoulder surfaces of each of the shoulder notch portions are parallel to said flat top portion.

8. A block according to claim 3 wherein the location of the horizontal shoulder surfaces are disposed at a point located a distance from the top portion of said block of between about 75.00% and 90.00% of the total height dimension of said block, including every hundredth percentage therebetween.

9. A block according to claim 8 wherein the distance the protruding portion protrudes downwardly from the horizontal shoulder surfaces is between about 3.00% and 35.00% of the total height dimension of said block, including every hundredth percentage therebetween.

10. A block according to claim 1 wherein said floor portion has a contour selected from the group consisting of: semi-circular, rectangular, and v-shaped as viewed from a cross-sectional aspect.

11. A block according to claim 1 wherein said length dimension is any length in the range of between 6.00 and 45.00 inches, including every hundredth inch therebetween.

12. A block according to claim 1 wherein said width dimension is any length in the range of between 3.00 and 15.00 inches, including every hundredth inch therebetween.

13. A block according to claim 1 wherein said height dimension is any length in the range of between 8.00 and 30.00 inches, including every hundredth inch therebetween.

14. A block according to claim 1, wherein said block is composed of cement and polymer particles.

15. A block useful in the construction of walls that is shaped in the general form of a rectangular solid having a length dimension, a width dimension, and a height dimension, comprising:

a) a flat top portion;

b) a flat bottom portion;

c) a front face portion;

d) a rear face portion;

e) a first end portion; and f) a second end portion, g) a single channel portion of uniform depth extending along the entire length dimension of the block, which channel has an upper portion coincident with said top portion of said block, and which channel has a floor portion whose lowermost point is disposed at depth of between 20.0% to 80.0% of the height dimension of said block, including every hundredth percentage therebetween, and wherein said channel has a width of between 20.0% to 80.0% of the width dimension of said block, including every hundredth percentage therebetween; and h) a single protruding portion, which protruding portion extends along the entire length dimension of the block and is defined by said flat bottom portion and a pair of intersecting shoulder notch portions each having a single shoulder surface and a single vertical shoulder surface which extends along the entire length dimension of said block, with one of said shoulder notch portions being disposed on each side of said protruding portion along the entire length of the protruding portion, and wherein each of said shoulder notch portions is formed from the intersection of said horizontal shoulder surface and said vertical shoulder surface, wherein said horizontal shoulder surface and said vertical shoulder surface form a single angle at their point of intersection, said channel including at least one hole on its floor portion having a centerline coincident with the height dimension of said block which hole passes through to the exterior of the block through said flat bottom portion, and wherein the height dimension is defined as the distance between said flat bottom portion and said flat top portion, and wherein each of the shoulder notch portions are disposed at a point along the height dimension between the flat bottom portion and the flat top portion.

16. A block as in claim 15 wherein said protruding portion comprises a width dimension which is less than the width of said channel portion.

17. A block as in claim 15 wherein said shoulder notch portions are each formed by the intersection of a horizontal shoulder surface and a vertical shoulder surface.

18. A block as in claim 17 wherein said single angle at which said horizontal shoulder surface and said vertical shoulder surface intersect is any angle between about 60 degrees and 120 degrees.

19. A block as in claim 17 wherein the angle at which said horizontal shoulder surface and said vertical shoulder surface intersect is about 90 degrees.

20. A block as in claim 17 wherein the horizontal shoulder surfaces of each of the shoulder notch portions are parallel to one another.

21. A block as in claim 17 wherein the horizontal shoulder surfaces of each of the shoulder notch portions are parallel to said flat top portion.

22. A block according to claim 17 wherein the location of the horizontal shoulder surfaces are disposed at a point located a distance from the top portion of said block of between about 75.00% and 90.00% of the total height dimension of said block, including every hundredth percentage therebetween.

23. A block according to claim 22 wherein the distance the protruding portion protrudes downwardly from the horizontal shoulder surfaces is between about 3.00% and 35.00% of the total height dimension of said block, including every hundredth percentage therebetween.

24. A block according to claim 15 wherein said floor portion has a contour selected from the group consisting of: semi-circular, rectangular, and v-shaped as viewed from a cross-sectional aspect.

25. A block according to claim 15 wherein said length dimension is any length in the range of between 6.00 and 45.00 inches, including every hundredth inch therebetween.

26. A block according to claim 15 wherein said width dimension is any length in the range of between 3.00 and 15.00 inches, including every hundredth inch therebetween.

27. A block according to claim 15 wherein said height dimension is any length in the range of between 8.00 and 30.00 inches, including every hundredth inch therebetween.

28. A block according to claim 15 wherein said channel includes at least two holes on its floor portion each having a centerline coincident with the height dimension of said block and wherein each hole passes through to said flat bottom portion.

29. A block according to claim 28, wherein said block is composed of cement and polymer particles.

30. A block according to claim 29 wherein the amount of cement in said block is any amount between 10.00 and 40.00% by volume based upon the total volume of the block, including every hundredth percentage therebetween.

31. A block according to claim 29 wherein the amount of polymer in said block is any amount between 60.00 and 90.00% by volume based upon the total volume of the block, including every hundredth percentage therebetween.

32. A block according to claim 31 wherein said polymer particles comprise a polymer selected from the group consisting of polyethylene particles, polypropylene particles, and polystyrene particles.

33. A block according to claim 31 further comprising an effective reinforcing amount of a fibrous substance.

34. A block according to claim 33 wherein said fibrous substance comprises fibers made from a material selected from the group consisting of: polyethylene fibers, polypropylene fibers, and asbestos fibers.

35. A wall comprising a plurality of blocks according to claim 30 wherein said blocks are stacked upon on another in a staggered configuration, and wherein said holes that pass through the floor portion of the channel and flat bottom portion of a given block within the wall are aligned with those of blocks above and below said given block, thus defining a plurality of vertical channels within said wall comprising said holes, and wherein said channel portions define a plurality of horizontal channels that extend along the length of the wall at each level of blocks comprising said wall.

36. A wall according to claim 35 including a vertically-oriented rebar rod disposed within at least one of said vertical channels.

37. A wall according to claim 35 including one vertically-oriented rebar rod disposed within at each of said vertical channels.

38. A wall according to claim 35 including a horizontally-oriented rebar rod disposed within at least one of said horizontal channels.

39. A wall according to claim 35 including one horizontally-oriented rebar rod disposed within at each of said horizontal channels.

40. A wall according to claim 35 including a horizontally-oriented rebar rod disposed within at least one of said horizontal channels, and including a vertically-oriented rebar rod disposed within at least one of said vertical channels.

41. A wall according to claim 40 wherein said horizontally-oriented rebar rod and said vertically-oriented rebar rod intersect one another.

42. A wall according to claim 41 wherein said horizontally-oriented rebar rod and said vertically-oriented rebar rod are connected to one another at their point of intersection.

43. A wall according to claim 42 further comprising a cement disposed about each of said horizontally-oriented rebar rods and said vertically-oriented rebar rods.

44. A wall according to claim 35 including one horizontally-oriented rebar rod disposed within each of said horizontal channels and including one vertically-oriented rebar rod disposed within at each of said vertical channels.

45. A wall according to claim 44 wherein each of said horizontally-oriented rebar rods and said vertically-oriented rebar rods are all connected to one another at their points of intersection.

46. A wall according to claim 45 further comprising a cement disposed about each of said horizontally-oriented rebar rods and said vertically-oriented rebar rods.

47. A rigid wall construction made of construction blocks according to claim 15, wherein said blocks have a length dimension, a width dimension, and a height dimension, wherein said wall comprises linear rebar reinforcements existing within said wall construction coincident with the length and height dimensions of the blocks, and wherein the blocks within said wall construction are reinforced along their width dimension by a protruding portion disposed at the bottom portion of said blocks.

48. A rigid wall construction made of construction blocks according to claim 29, wherein said blocks have a length dimension, a width dimension, and a height dimension, wherein said wall comprises linear rebar reinforcements existing within said wall construction coincident with the length and height dimensions of the blocks, and wherein the blocks within said wall construction are reinforced along their width dimension by a protruding portion disposed at the bottom portion of said blocks.

49. A process for making a finished wall comprising the steps of:

a) providing a single first row of blocks according to claim 15 arranged end to end thus defining a first horizontal channel extending along the length of said row;

b) providing a first horizontal rebar within the first horizontal channel;

c) stacking a second row of blocks according to claim 15 atop said first row of blocks in a staggered configuration with respect to said first row of blocks, thus defining a second horizontal channel extending along the length of said second row of blocks;

d) providing a second horizontal rebar within the second horizontal channel;

e) stacking a successive row of blocks according to claim 15 atop the previous row of blocks in a staggered configuration with respect to said previous row of blocks, thus defining a successive horizontal channel extending along the length of said successive row of blocks;

f) providing a successive horizontal rebar within the successive horizontal channel;

g) repeating steps e) and f) until a desired height of blocks is achieved, wherein said holes that pass through the floor portion of the channel and flat bottom portion of a given block within the wall are aligned with those of blocks above and below said given block, thus defining a plurality of vertical channels within said wall and an upper horizontal channel disposed along the length of the topmost blocks;

h) providing a vertically-oriented rebar within each vertical channel; and i) pouring a castable cement into said vertical holes and said upper horizontal channel.

50. A process according to claim 49 further comprising the step of: j) connecting each horizontal rebar with each vertically-oriented rebar at their point of intersection prior to pouring said castable cement into said vertical holes and said upper horizontal channel.

51. A process according to claim 49 further comprising the step of placing an adhesive substance on any location of said blocks selected from the group consisting of: said flat top surfaces, said flat shoulder surfaces and said end portions of the blocks during the stacking a successive rows of blocks atop a previous row of blocks.

* * * * *